US007401893B2

(12) United States Patent
Otsuki

(10) Patent No.: US 7,401,893 B2
(45) Date of Patent: Jul. 22, 2008

(54) PRINTING METHOD, PRINTING APPARATUS, AND STORAGE MEDIUM

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 10/942,100

(22) Filed: Sep. 16, 2004

(65) Prior Publication Data

US 2005/0122375 A1 Jun. 9, 2005

(30) Foreign Application Priority Data

Sep. 18, 2003 (JP) ..... 2003-326298
Sep. 15, 2004 (JP) ..... 2004-267981

(51) Int. Cl.
*B41J 23/00* (2006.01)

(52) U.S. Cl. ..... 347/37

(58) Field of Classification Search ..... 347/5, 347/104, 37

See application file for complete search history.

(56) References Cited

FOREIGN PATENT DOCUMENTS

JP 2002-103586 * 4/2002
JP 2002-103586 A 4/2002

* cited by examiner

*Primary Examiner*—Stephen Meier
*Assistant Examiner*—Geoffrey Mruk
(74) *Attorney, Agent, or Firm*—Sughrue Mion, PLLC

(57) ABSTRACT

The present invention provides a printing method for printing a print image on a medium. A protruding section provided in a predetermined position in a predetermined direction supports the medium. A plurality of nozzles, whose positions are different from one another in a direction that intersects the predetermined direction, are moved. The plurality of nozzles includes nozzles that are in opposition to the protruding section and nozzles that are not in opposition to the protruding section while they are moved in the predetermined direction. In the case of printing the print image on the medium by ejecting ink from the plurality of moving nozzles toward the medium supported by the protruding section, when an edge of the medium in the predetermined direction is on the protruding section, the ink is not ejected from the nozzles that are in opposition to the protruding section and the ink is ejected from the nozzles that are not in opposition to the protruding section toward the edge of the medium in the predetermined direction.

7 Claims, 34 Drawing Sheets

PRINTING METHOD, PRINTING APPARATUS, AND STORAGE MEDIUM

CROSS-REFERENCE TO RELATED APPLICATIONS

The present application claims priority upon Japanese Patent Application No. 2003-326298 filed on Sep. 18, 2003, and upon Japanese Patent Application No. 2004-267981 filed on Sep. 15, 2004, which are herein incorporated by reference.

FIELD OF THE INVENTION

The present invention relates to printing methods, printing apparatuses, and storage media having a program stored thereon.

DESCRIPTION OF THE RELATED ART

In recent years, printers for printing information such as images or texts on a print medium with ink have been widely used as one type of output device for computers.

In such printers, when so-called "borderless printing" for printing an image over the entire print medium up to its edges without leaving borders is performed, image data larger than the print medium is used to perform printing in order to prevent borders (unprinted portions) at the edges of the print medium from occurring due to a mechanical control error of a paper feed control system and a print head.

However, if image data larger than the print medium is used to perform printing, then ink that has landed outside the print medium adheres to the inside of the printer (e.g., platen), making the print medium and the apparatus itself dirty.

Thus, the applicant of the present application has already filed an invention for preventing the platen from becoming dirty by providing a recessed section in the platen and disposing an absorbing material therein and, when borderless printing is performed, controlling the position at which ink is ejected from the print head so that ink that has landed outside the print medium is absorbed by the absorbing material (Japanese Laid open Patent Publication No. 2002-103586).

In some cases, a plurality of protruding sections that come in contact with the rear surface (surface that is the other side of the printing surface) of the print medium are provided and the absorbing material is disposed in the peripheries of the protruding sections in order to prevent the possibility that the print medium comes in contact with the absorbing material and the rear surface of the print paper becomes dirty due to ink.

The size and the position of each of such a plurality of protruding sections are determined so that, when a standard sized paper (e.g., A4, B5, postcard, and Japanese L size (127 mm×89 mm)) is placed, the left and right edges (edges in the movement direction) of the paper are positioned over the absorbing material.

In such a printing apparatus, for example, when a print medium other than the standard sized papers is used, the left and right edges of the print medium may be positioned on top of the protruding section described above instead of being positioned over the absorbing material, in which case ink lands on the protruding section and makes it dirty.

Moreover, when the subsequent print medium is to be printed while ink is adhering to the protruding section, then there is also a problem that the ink adhering to the protruding section adheres to the rear surface of the print medium and makes it dirty.

SUMMARY OF THE INVENTION

The present invention was arrived in light of the foregoing matters, and it is an object thereof to prevent ink from adhering to the inside of the printer and the rear surface of the print medium even when borderless printing is performed using a non-standard sized print medium.

A main invention for achieving the foregoing object is a printing method for printing a print image on a medium, comprising the following steps of:

supporting the medium with a protruding section provided in a predetermined position in a predetermined direction;

moving a plurality of nozzles whose positions are different from one another in a direction that intersects the predetermined direction, wherein the plurality of nozzles comprises nozzles that are in opposition to the protruding section and nozzles that are not in opposition to the protruding section while they are moved in the predetermined direction; and printing the print image on the medium by ejecting ink from the plurality of moving nozzles toward the medium supported by the protruding section, wherein when an edge of the medium in the predetermined direction is on the protruding section, the ink is not ejected from the nozzles that are in opposition to the protruding section and the ink is ejected from the nozzles that are not in opposition to the protruding section toward the edge of the medium in the predetermined direction.

Features and objects of the present invention other than the above will become clear by reading the description of the present specification with reference to the accompanying drawings.

Figure 1:
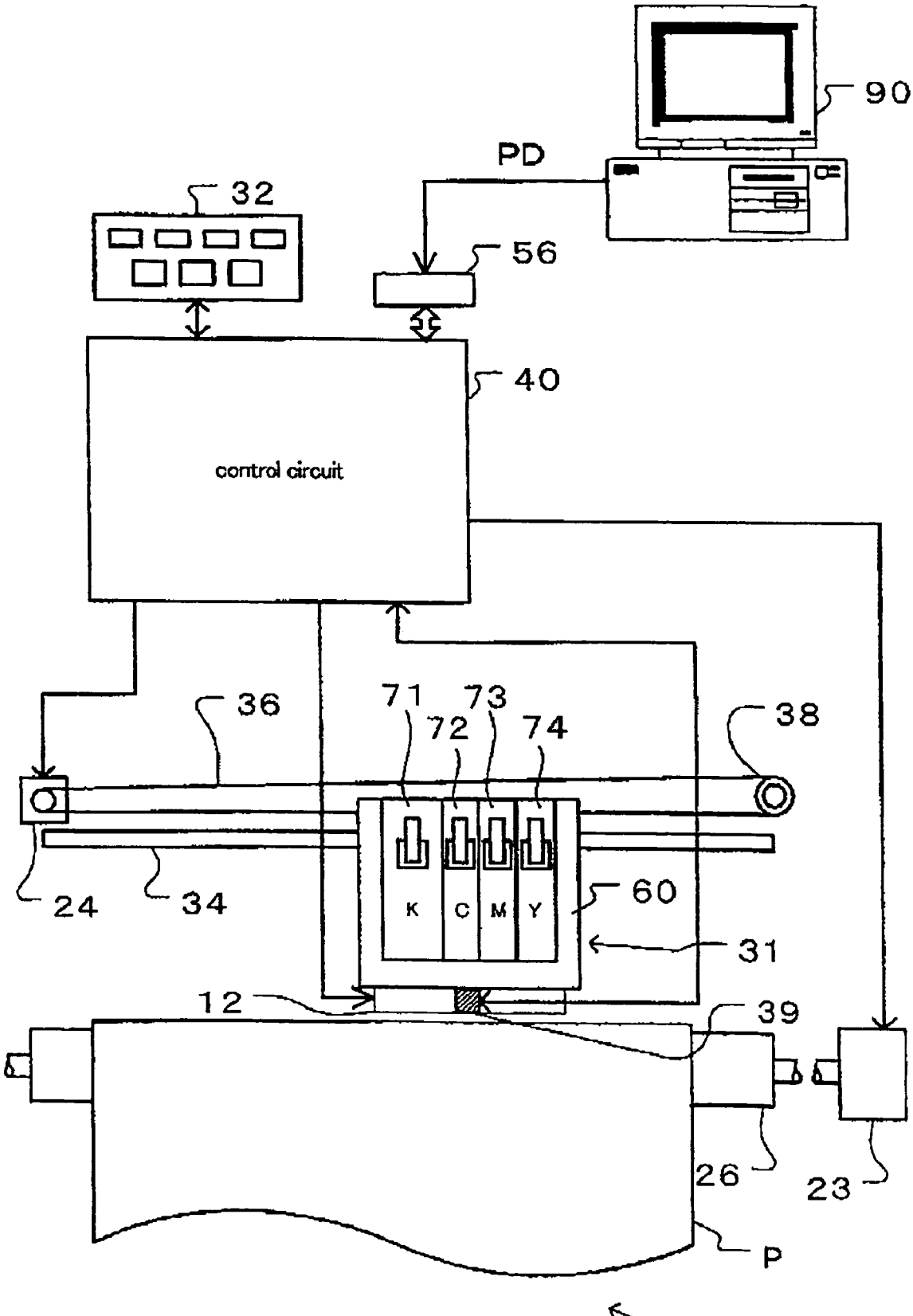
FIG. 1 is a diagram schematically showing a configuration of primary components of a printing apparatus according to this embodiment.

For a more complete understanding of the present invention and the advantages thereof, reference is now made to the following description taken in conjunction with the accompanying drawings.

DESCRIPTION OF PREFERRED EMBODIMENTS

Overview of the Disclosure 1

At least the following matters will be made clear by the present specification and the description of the accompanying drawings.

A printing method for printing a print image on a medium, comprises the following steps of:

supporting the medium with a protruding section provided in a predetermined position in a predetermined direction;

moving a plurality of nozzles whose positions are different from one another in a direction that intersects the predetermined direction, wherein the plurality of nozzles comprises nozzles that are in opposition to the protruding section and nozzles that are not in opposition to the protruding section while they are moved in the predetermined direction; and printing the print image on the medium by ejecting ink from the plurality of moving nozzles toward the medium supported by the protruding section, wherein when an edge of the medium in the predetermined direction is on the protruding section, the ink is not ejected from the nozzles that are in opposition to the protruding section and the ink is ejected from the nozzles that are not in opposition to the protruding section toward the edge of the medium in the predetermined direction.

According to this printing method, it is possible to prevent ink from adhering to the protruding section for supporting the medium.

In the printing method, it is desirable that whether or not the edge of the medium in the predetermined direction is on the protruding section is determined in accordance with a length of the medium in the predetermined direction. Moreover, in the printing method, it is preferable that the length of the medium in the predetermined direction is detected by detecting the edge of the medium in the predetermined direction. Furthermore, it is preferable that the length of the medium in the predetermined direction is detected by obtaining information about a size of the medium. In this way, it is possible to determine whether or not to eject ink from the nozzles that are in opposition to the protruding section.

In the printing method, it is desirable that ink that does not land on the medium is absorbed by an absorbing material. In this way, accumulation of ink can be reduced.

In the printing method, it is desirable that when the edge of the medium in the predetermined direction is not on the protruding section, the ink is ejected from the nozzles that are in opposition to the protruding section and the nozzles that are in opposition to the protruding section toward the edge of the medium in the predetermined direction. In this way, the print speed can be improved.

In the printing method, it is desirable that when the edge of the medium in the predetermined direction is not on the protruding section and when a distance in the predetermined direction between a region to which the ink is ejected and the protruding section that is not supporting the medium is shorter than a predetermined distance, the ink is not ejected from the nozzles that are in opposition to the protruding section and the ink is ejected from the nozzles that are not in opposition to the protruding section toward the edge of the medium in the predetermined direction. In this way, even when a margin is small, it is possible to prevent ink from adhering to the protruding section.

In the printing method, it is desirable that the nozzles that are in opposition to the protruding section are sandwiched between two groups of nozzles that are not in opposition to the protruding section. In this way, it is possible to provide the protruding section in a central portion of the platen in the carrying direction.

In the printing method, it is desirable that when the edge of the medium in the predetermined direction is not on the protruding section, the ink is ejected from one of the two groups of nozzles that are not in opposition to the protruding section toward a top edge of the medium, and the ink is ejected from the other of the two groups of nozzles that are not in opposition to the protruding section toward a bottom edge of the medium; and that when the edge of the medium in the predetermined direction is on the protruding section, the ink is ejected from one of the two groups of nozzles that are not in opposition to the protruding section toward the top edge of the medium, and the ink is ejected from the one of the two groups of nozzles that are not in opposition to the protruding section toward the bottom edge of the medium. In this way, the image quality of the print image is improved. Moreover, it is preferable that when the number of nozzles for ejecting the ink is N, a spacing of dots formed on the medium is D, and a nozzle pitch is k×D, N and k are coprime, and a carry amount of the medium is N×D. In this way, it is possible to obtain the print image at a resolution higher than the nozzle pitch while carrying the medium using a constant carry amount.

In the printing method, it is desirable that when the edge of the medium in the predetermined direction is on the protruding section, ink is ejected toward the medium from both of the two groups of nozzles that are not in opposition to the protruding section and that sandwich the nozzles that are in opposition to the protruding section. Moreover, it is preferable that when the number of nozzles for ejecting the ink is N, a spacing of dots formed on the medium is D, and a nozzle pitch is k×D, N/2 is coprime, and a carry amount of the medium is (N/2)×D. In this way, the image quality of the print image is improved. Furthermore, it is preferable that when the edge of the medium in the predetermined direction is on the protruding section, the medium is carried in a carrying direction and a reverse direction, and ink is ejected alternately from one and the other of the two groups of nozzles that are not in opposition to the protruding section.

In the printing method, it is desirable that the nozzles that are not in opposition to the protruding section are sandwiched between two groups of nozzles that are in opposition to the protruding section.

A printing apparatus comprises:

a protruding section provided in a predetermined position in a predetermined direction for supporting a medium;

a moving section for moving, in the predetermined direction, a plurality of nozzles whose positions are different from one another in a direction that intersects the predetermined direction; and a controller for performing control such that when an edge of the medium in the predetermined direction is on the protruding section, ink is not ejected from nozzles that are in opposition to the protruding section while they are moved and the ink is ejected toward the edge of the medium in the predetermined direction from nozzles that are not in opposition to the protruding section while they are moved.

According to this printing apparatus, it is possible to prevent ink from adhering to the protruding section for supporting the medium.

A computer-readable storage medium comprises:

a memory for storing a program, the program having codes for causing a printing apparatus that is provided with a protruding section provided in a predetermined position in a predetermined direction for supporting a medium; and a moving section for moving, in the predetermined direction, a plurality of nozzles whose positions are different from one another in a direction that intersects the predetermined direction, to operate such that when an edge of the medium in the predetermined direction is on the protruding section, ink is not ejected from nozzles that are in opposition to the protruding section while they are moved and the ink is ejected toward the edge of the medium in the predetermined direction from nozzles that are not in opposition to the protruding section while they are moved.

According to this program, it is possible to control the printing apparatus so that ink is prevented from adhering to the protruding section for supporting the medium.

Overview of the Disclosure 2

Moreover, at least the following matters also will be made clear by the present specification and the description of the accompanying drawings.

In this embodiment, a printing apparatus for printing a desired image on a print medium by inputting image data and ejecting ink from a print head in correspondence with the image data includes a detecting Means for detecting that image data having a width larger than the width of the print medium in a main-scanning direction is to be printed; a determining means for determining whether or not an area of the image data that lies outside the print medium in the main-scanning direction and that is to be printed by one main scan of the print head fits within an area in which an absorbing material for absorbing ink is disposed, when the detecting means detects that the image data having a width larger than the width of the print medium in the main-scanning direction is to be printed; and a printing means for performing printing using only nozzles belonging to the area in which the absorbing material is disposed, of a plurality of nozzles arranged in a sub-scanning direction, when the determining means determines that the area of the image data extends beyond an area in which the absorbing material is not disposed.

Therefore, even when borderless printing is performed using a non-standard sized print medium, it is possible to prevent ink from adhering to the inside of the printer and the rear surface of the print medium.

Moreover, the determining means determines whether or not the area of the image data that lies outside the print medium in the main-scanning direction and that is to be printed by one main scan of the print head fits within the area in which the absorbing material for absorbing ink is disposed. Therefore, it is possible to reliably prevent ink from adhering to the inside of the printer.

Moreover, the determining means further determines whether or not the area of the image data that lies outside the print medium in the main-scanning direction and that is to be printed by one main scan of the print head is at a predetermined distance from a section in which the absorbing material is not disposed. Therefore, even when a path along which an ink droplet flies is deviated, it is possible to reliably prevent ink from adhering to the inside of the printer.

Moreover, the absorbing material has a first region in which it is formed continuously in the main-scanning direction and a second region in which it is formed discontinuously in the main-scanning direction, and the printing means performs printing using nozzles belonging to the first and the second regions, when the determining means determines that the area of the image data that lies outside the print medium in the main-scanning direction and that is to be printed by one main scan of the print head fits within an area in which the absorbing material in the second region is disposed, and on the other hand, it performs printing using only the nozzles belonging to the first region, when the determining means determines that the area of the image data that lies outside the print medium in the main-scanning direction and that is to be printed by one main scan of the print head does not fit within the area in which the absorbing material in the second region is disposed. Therefore, it is possible to perform printing at a high speed with respect to a standard sized paper and to perform printing such that ink is kept from adhering to the inside of the printer with respect to a non-standard sized paper.

Moreover, the absorbing material further has a third region in which it is formed continuously in the main-scanning direction, and the first, the second, and the third regions are arranged in this order from the upstream side toward the downstream side, and the printing means performs printing using nozzles belonging to all of the first, the second, and the third regions, when the determining means determines that the area of the image data that lies outside the print medium in the main-scanning direction and that is to be printed by one main scan of the print head fits within the area in which the absorbing material in the second region is disposed, and on the other hand, it performs printing using the nozzles belonging to the third region for the top edge processing, using the nozzles belonging to the first region for the bottom edge processing, and using the nozzles belonging to either of the first and the third regions or the nozzles belonging to both of these regions for the normal printing, when the determining means determines that the area of the image data that lies outside the print medium in the main-scanning direction and that is to be printed by one main scan of the print head does not fit within the area in which the absorbing material in the second region is disposed. Therefore, it is possible to perform printing at a high speed with respect to a standard sized paper and to perform printing such that ink is kept from adhering to the inside of the printer with respect to a non-standard sized paper.

Moreover, a sensor for detecting the width of the print medium in the main-scanning direction is further included, and the determining means determines whether or not the area that is to be printed by one main scan of the print head fits within the area in which the absorbing material for absorbing ink is disposed based on an area of the print medium detected by the sensor and the detection result of the detecting means. Therefore, it is possible to reliably detect the width of the print medium in the main-scanning direction.

Moreover, the sensor is an optical sensor provided in the print head and detects the width of the print medium in accordance with the back and forth motion of the print head in the main-scanning direction. Therefore, it is possible to correctly detect the width of the print medium.

Moreover, the determining means determines whether or not the area to be printed by one main scan of the print head fits within the area in which the absorbing material for absorbing ink is disposed in accordance with information indicating the area of the absorbing material and information received from the sensor. Therefore, it is possible to detect a position even with a single optical sensor by moving the print head back and forth in the left and right direction.

Moreover, in this embodiment, a printing method for printing a desired image on a print medium by inputting image data and ejecting ink from a print head in correspondence with the image data includes a detecting step of detecting that image data having a width larger than the width of the print medium in a main-scanning direction is to be printed; a determining step of determining whether or not an area of the image data that lies outside the print medium in the main-scanning direction and that is to be printed by one main scan of the print head fits within an area in which an absorbing material for absorbing ink is disposed, when it is detected in the detecting step that the image data having a width larger than the width of the print medium in the main-scanning direction is to be printed; and a printing step of performing printing using only nozzles belonging to the area in which the absorbing material is disposed, of a plurality of nozzles arranged in a sub-scanning direction, when it is determined in the determining step that an area of the image data extends beyond an area in which the absorbing material is not disposed.

Therefore, according to this method, even when borderless printing is performed using a non-standard sized print medium, it is possible to prevent ink from adhering to the inside of the printer and the rear surface of the print medium.

Moreover, in this embodiment, a computer-readable program for printing, which makes a computer perform a function of processing for printing a desired image on a print medium by inputting image data and ejecting ink from a print head in correspondence with the image data, makes the computer function as a detecting means for detecting that image data having a width larger than the width of the print medium in a main-scanning direction is to be printed; a determining means for determining whether or not an area of the image data that lies outside the print medium in the main-scanning direction and that is to be printed by one main scan of the print head fits within an area in which an absorbing material for absorbing ink is disposed, when the detecting means detects that the image data having a width larger than the width of the print medium in the main-scanning direction is to be printed; and a printing means for performing printing using only nozzles belonging to the area in which the absorbing material is disposed, of a plurality of nozzles arranged in a sub-scanning direction, when the determining means determines that an area of the image data extends beyond an area in which the absorbing material is not disposed.

Therefore, when this program is installed on the computer, it is possible to prevent ink from adhering to the inside of the printer and the rear surface of the print medium even when borderless printing is performed using a non-standard sized print medium.

Hereinafter, an embodiment of the present invention is described with reference to the drawings.

Outline of the Printing Apparatus

<Regarding a Configuration of the Printing Apparatus>

First, an overview of a printing apparatus according to an embodiment of the present invention is described with reference to FIGS. 1 and 2. It should be noted that in the present specification, a combination of a printer 22 and a computer 90 is referred to as the "printing apparatus". Moreover, "image" includes not only images such as natural images but also line drawings and texts, that is, it includes images, characters, and line drawings, for example, which are obtained from both of so-called image data and so-called text data.

FIG. 1 is a diagram schematically showing a configuration of the printer 22 constituting the printing apparatus. FIG. 2 is a block diagram showing an example of a configuration of primary components of the printer 22, focusing on a control circuit 40.

As shown in FIG. 1, the printer 22 has a carrying mechanism (sub-scan feed mechanism) for carrying a print paper P serving as a print medium using a paper feed motor 23, and a moving mechanism (main-scan feed mechanism) for moving a carriage 31 back and forth in the axial direction of a paper feed roller 26 using a carriage motor 24. Here, the direction in which the print paper P is fed by the carrying mechanism is referred to as the carrying direction (sub-scanning direction), and the direction in which the carriage 31 is moved by the moving mechanism is referred to as the movement direction (main-scanning direction).

Moreover, the printer 22 is provided with a print head unit 60, which is mounted to the carriage 31 and provided with a print head 12, a head drive mechanism for controlling ejection of ink and dot formation by driving the print head unit 60, and a control circuit 40 for sending and receiving signals to and from the paper feed motor 23, the carriage motor 24, the print head unit 60, and an operation panel 32.

Next, the configuration of the print head 12 is described with reference to FIG. 1.

As shown in FIG. 1, on the carriage 31, four ink cartridges 71 to 74, that is, a cartridge 71 containing black (K) ink, a cartridge 72 containing cyan (C) ink, a cartridge 73 containing magenta (M) ink, and a cartridge 74 containing yellow (Y) ink, are removably mounted The print head 12 is provided in a lower part of the carriage 31. In the print head 12, nozzle rows corresponding to respective colors of ink are formed. In each nozzle row, nozzles, which serve as ink ejecting sections, are arranged in a row in the carrying direction of the print paper P.

Moreover, in the nozzle rows provided in the lower part of the carriage 31 and associated with respective colors of ink, a piezo element, which is one type of electrostrictive element and has excellent response characteristics, is provided for each nozzle. The piezo element is disposed in a position in which it is in contact with a member that forms an ink channel for guiding ink to the nozzle. The piezo element whose crystal structure deforms when a voltage is applied converts electric energy into mechanical energy very quickly.

In this embodiment, by applying a voltage of a predetermined duration between electrodes provided on both ends of the piezo element, the piezo element expands during the voltage application time and deforms one side wall of the ink channel. As a result, the volume of the ink channel is contracted in response to the expansion of the piezo element, causing an amount of ink that corresponds to the amount of the contraction to be ejected as an ink droplet from the tip of the nozzle at a high velocity. The ink droplet soaks into the print paper P carried along the paper feed roller 26 to form a dot, and thus printing is performed. The size of the ink droplet can be changed in accordance with the method for applying a voltage to the piezo element. Thus, it is possible to form dots having three different sizes, that is, large, medium, and small sizes.

The control circuit 40 is connected to a computer 90 via a connector 56. The computer 90 is provided with a printer driver program for the printer 22 as described later, and constitutes a user interface for receiving commands from a user through operation of a keyboard, a mouse, or the like serving as an input device and for presenting various information in the printer 22 by displaying them on a screen of a display device.

The carrying mechanism for carrying the print paper P is provided with a gear train (not shown) for transmitting rotation of the paper feed motor 23 to the paper feed roller 26 and a paper carry roller (not shown).

Moreover, the moving mechanism for moving the carriage 31 back and forth is provided with a slide shaft 34 constructed parallel to the axis of the paper feed roller 26 and for slidably holding the carriage 31; a pulley 38 for suspending an endless drive belt 36 that is stretched between the pulley 38 and the carriage motor 24; and an optical sensor 39 for detecting the position of the origin of the carriage 31. It should be noted that the optical sensor 39 is constituted by a light source for projecting light onto the print paper P and a photodiode (or a CCD element) for converting reflected light from the print paper P into a corresponding image signal.

Figure 2:
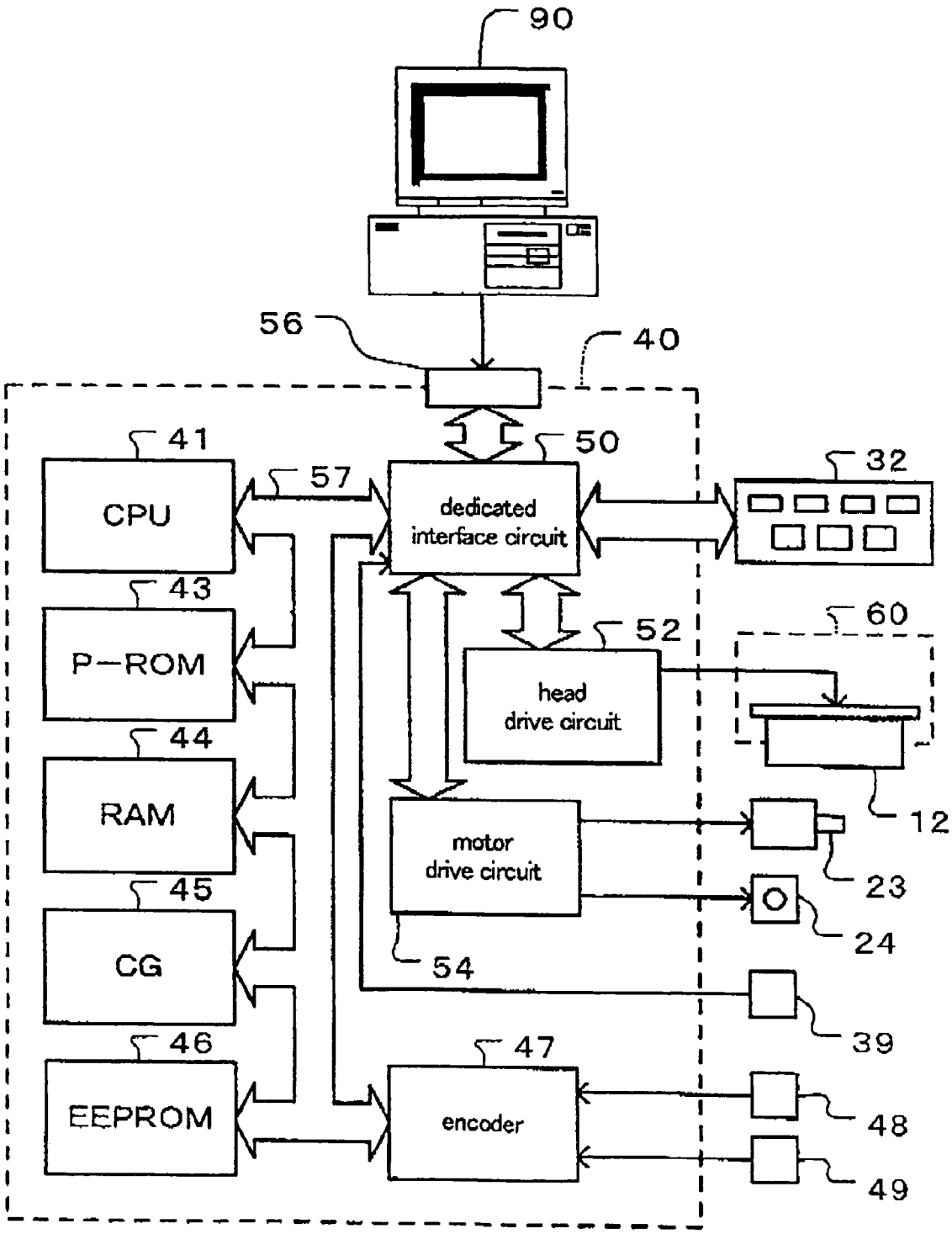
FIG. 2 is a block diagram showing a detailed configuration example of a control circuit of a printer shown in FIG. 1.

As shown in FIG. 2, the control circuit 40 is configured as an arithmetic and logic unit provided with a CPU (Central Processing Unit) 41 serving as a printing means, a programmable ROM (P-ROM (Read only Memory)) 43, a RAM (Random Access Memory) 44, a character generator (CG) 45 that stores dot matrices of characters, an EEPROM (Electronically Erasable and Programmable ROM) 46, and an encoder 47. The encoder 47 detects the position of the carriage 31 in the movement direction based on a detection signal received from a detecting section 48 contained in the carriage motor 24. Also, the encoder 47 detects the position of the print paper P in the carrying direction based on a detection signal received from a detecting section 49 contained in the paper feed motor 23.

The control circuit 40 is further provided with a dedicated interface circuit 50 serving as an interface (I/F) with an external motor, for example; a head drive circuit 52 connected to the dedicated interface circuit 50 and for driving the print head unit 60 to make it eject ink; and a motor drive circuit 54 for driving the paper feed motor 23 and the carriage motor 24.

The dedicated interface circuit 50 contains a parallel interface circuit, so that it can receive print data PD supplied from the computer 90 via the connector 56.

<Regarding Configurations of the Print Head 12 and the Platen 300>

Figure 3:
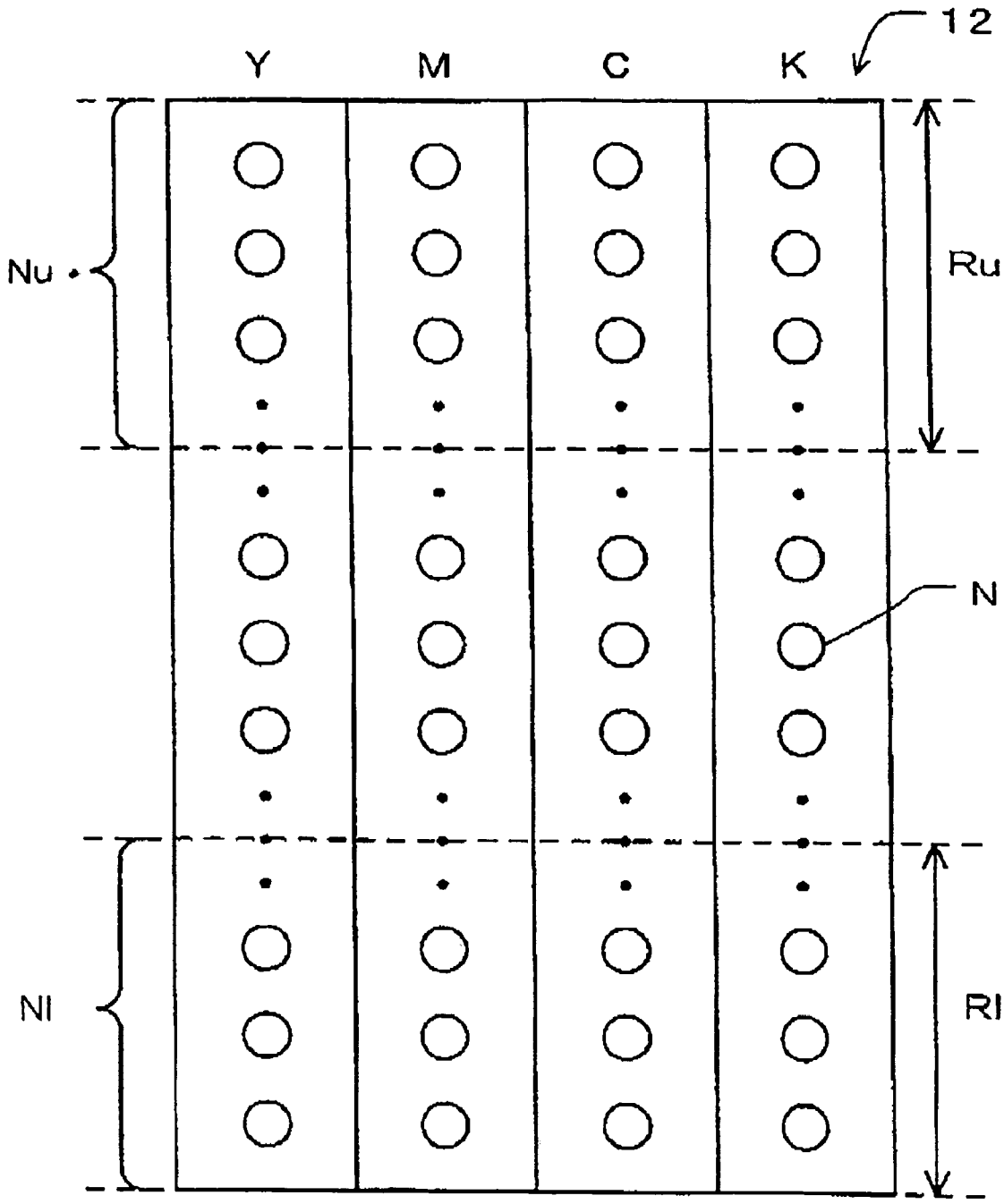
FIG. 3 is a diagram showing a detailed configuration example of nozzles provided in a print head in the printing apparatus shown in FIG. 1.

FIG. 3 is an explanatory diagram showing the arrangement of nozzles N in the print head 12. In the print head 12, four nozzle arrays (nozzle rows) for ejecting ink for the respective colors of black (K), cyan (C), magenta (M), and yellow (Y) are arranged. The four nozzle arrays are arranged parallel to each other along the movement direction. Each nozzle array has 180 nozzles arranged in a row at a constant nozzle pitch. It should be noted that the nozzle pitch means a spacing between the nozzles, and in this embodiment it is 180 dpi (1/180 inch). When a spacing between dots in the carrying direction is D, the nozzle pitch also may be expressed as k×D. For example, when the dot spacing D is 720 dpi (1/720 inch), the nozzle pitch of this embodiment is 4×D (k=4). That is, k is a value indicating the number of raster lines (i.e., the number of pixels) corresponding to the spacing, in the carrying direction, between the nozzles arranged on the print head 12. For example, when the nozzles are arranged such that three raster lines are interposed between them, then k is 4. "Raster line" refers to a row of pixels lined up in the movement direction.

Figure 4:
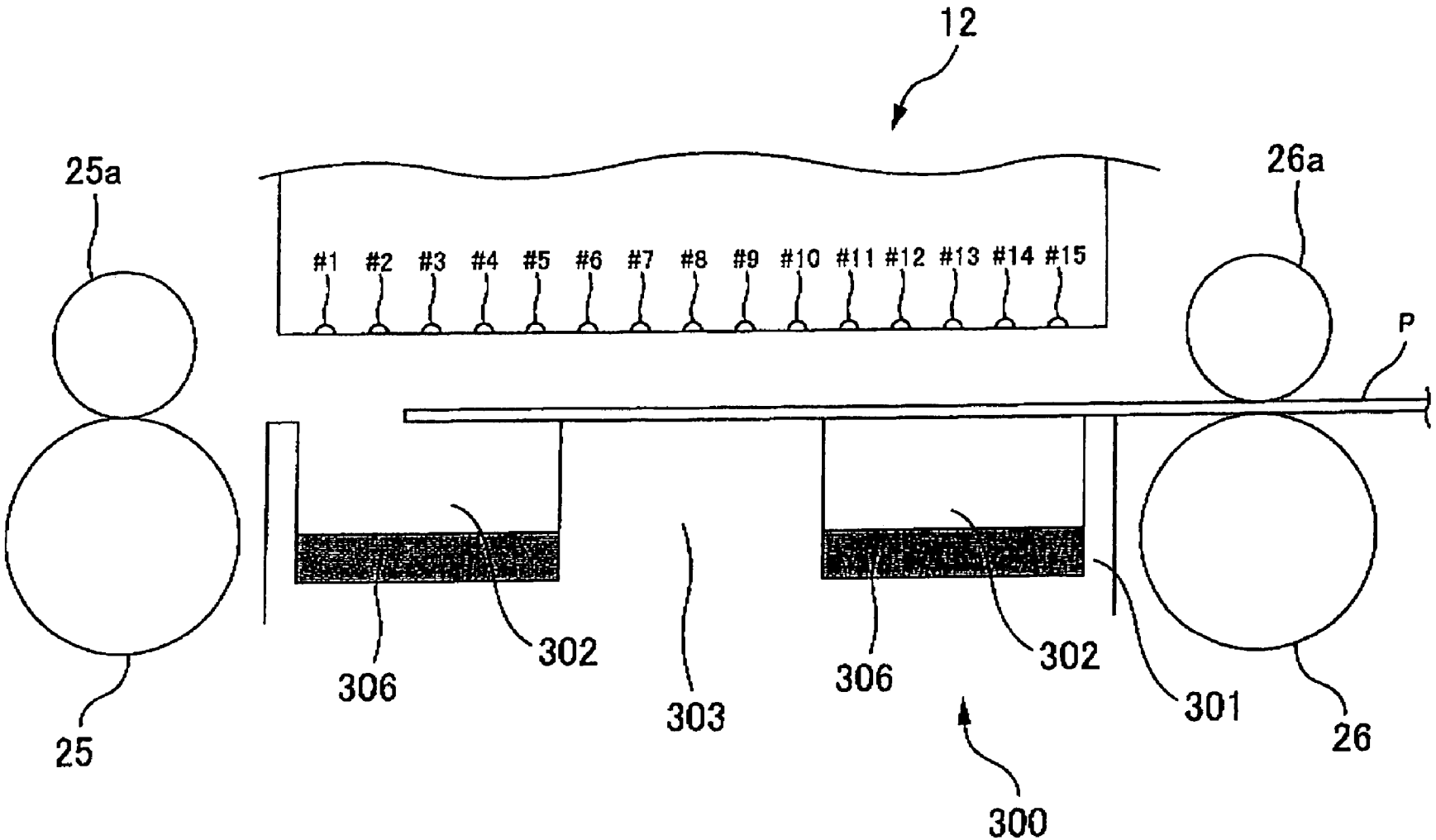
FIG. 4 is a diagram showing the relationship of the print head, a print paper, and a platen in the printing apparatus shown in FIG. 1, for describing the manner in which printing is performed with ink landing outside a top and a bottom edge of the print paper.

As shown in FIG. 4, the print head 12 is provided in a position that is in opposition to a platen 300. The platen 300 is disposed between the paper feed roller 26 and a paper discharge roller 25 and holds the print paper P so that the distance between the print head 12 and the print paper P, which is carried by the paper feed roller 26 and a driven roller **26*a* and the paper discharge roller 25 and a driven roller 25*a*, is kept constant. Moreover, a recessed section 302 is provided in the upper section of the platen 300, and an absorbing material 306 for absorbing ink is disposed at the bottom thereof also, a protruding section 303 is provided in the central portion of the recessed section 302. In FIG. 4, numerals 1 to 15** indicate the nozzle number. In practice, about 180 nozzles are present as described above, but in the following, it is assumed that the number of nozzles is 15 for the sake of simplifying the description. Also, in the following, the numbers of the nozzles are provided with "#" so as to indicate the nozzles.

An area Ru indicated by broken lines in FIG. 3 is a predetermined area on the upstream side (the side that the front end of the print paper P reaches earlier) in the carrying direction, of the nozzles N in the print head 12. As shown in FIG. 4, in a portion of the platen 300 that is opposed to the area Ru of the print head 12, the recessed section 302 on the upstream side is present. That is, #11 to #15 of the nozzle rows for the respective colors are provided in a position that is opposed to the recessed section 302 on the upstream side. A set of the nozzles that are opposed to the recessed section 302 on the upstream side (a set of these nozzle rows for the respective colors) is expressed as a nozzle group Nu.

In the same manner, an area Rl indicated by broken lines in FIG. 3 is a predetermined area on the downstream side (the side that the front end of the print-paper P reaches later) in the carrying direction, of the nozzles N in the print head 12. As shown in FIG. 4, in a portion of the platen 300 that is opposed to the area Rl of the print head 12, the recessed section 302 on the downstream side is present. That is, #1 to #5 of the nozzle rows for the respective colors are provided in a position that is opposed to the recessed section 302 on the downstream side. A set of the nozzles that are opposed to the recessed section 302 on the downstream side (a set of these nozzle rows for the respective colors) is expressed as a nozzle group Nl.

Figure 5:
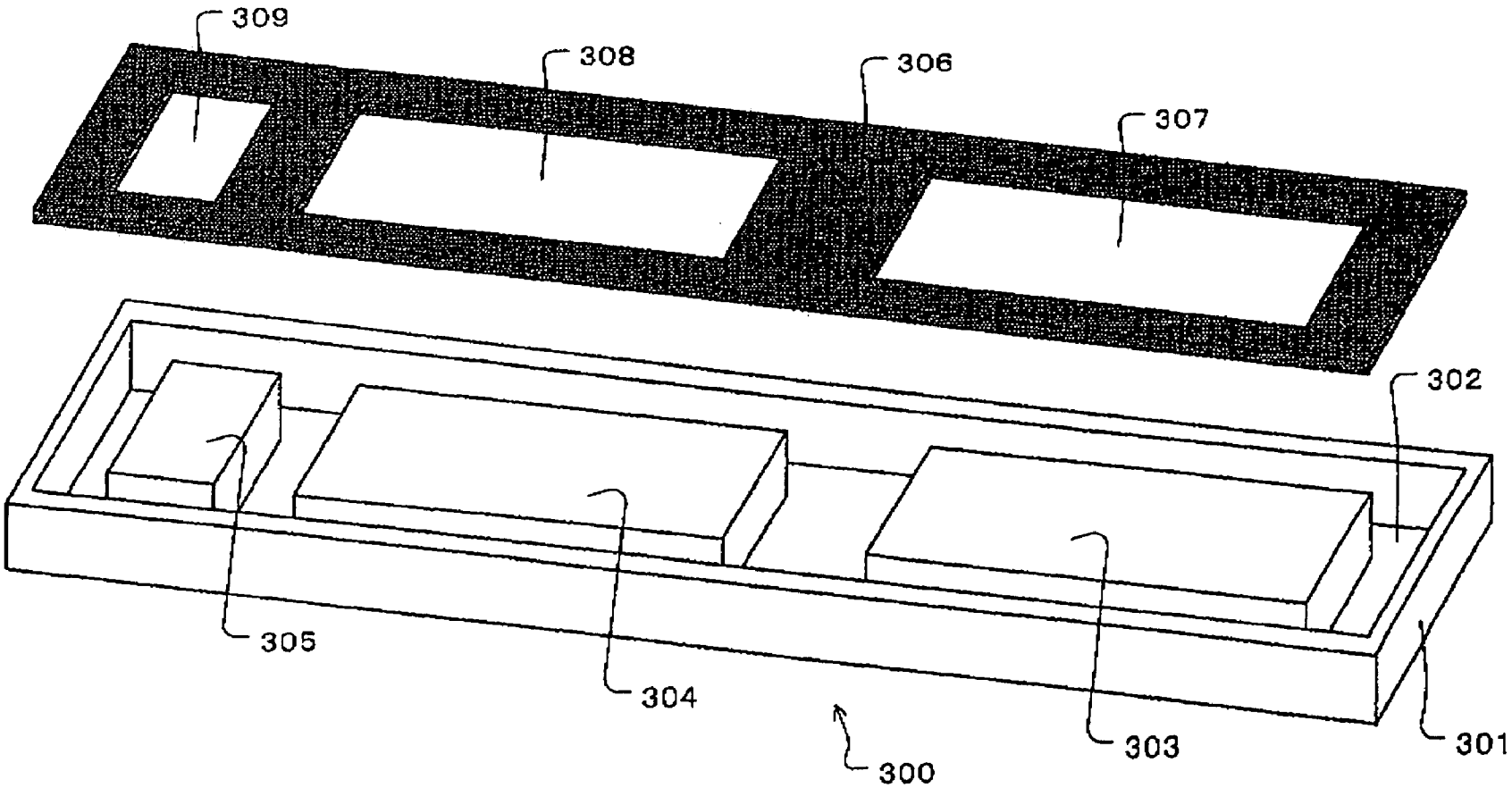
FIG. 5 is a diagram showing a detailed configuration example of the platen shown in FIG. 4.

FIG. 5 is a diagram for explaining a detailed configuration example of the platen 300. As shown in this diagram, the platen 300 is constituted by a frame 301 having the recessed section. 302 therein, and protruding sections 303 to 305 are provided in the recessed section 302. At the bottom portion of the recessed section 302, the absorbing material 306 having rectangular openings 307 to 309 through which the respective protruding sections 303 to 305 pass is disposed.

Figure 6:
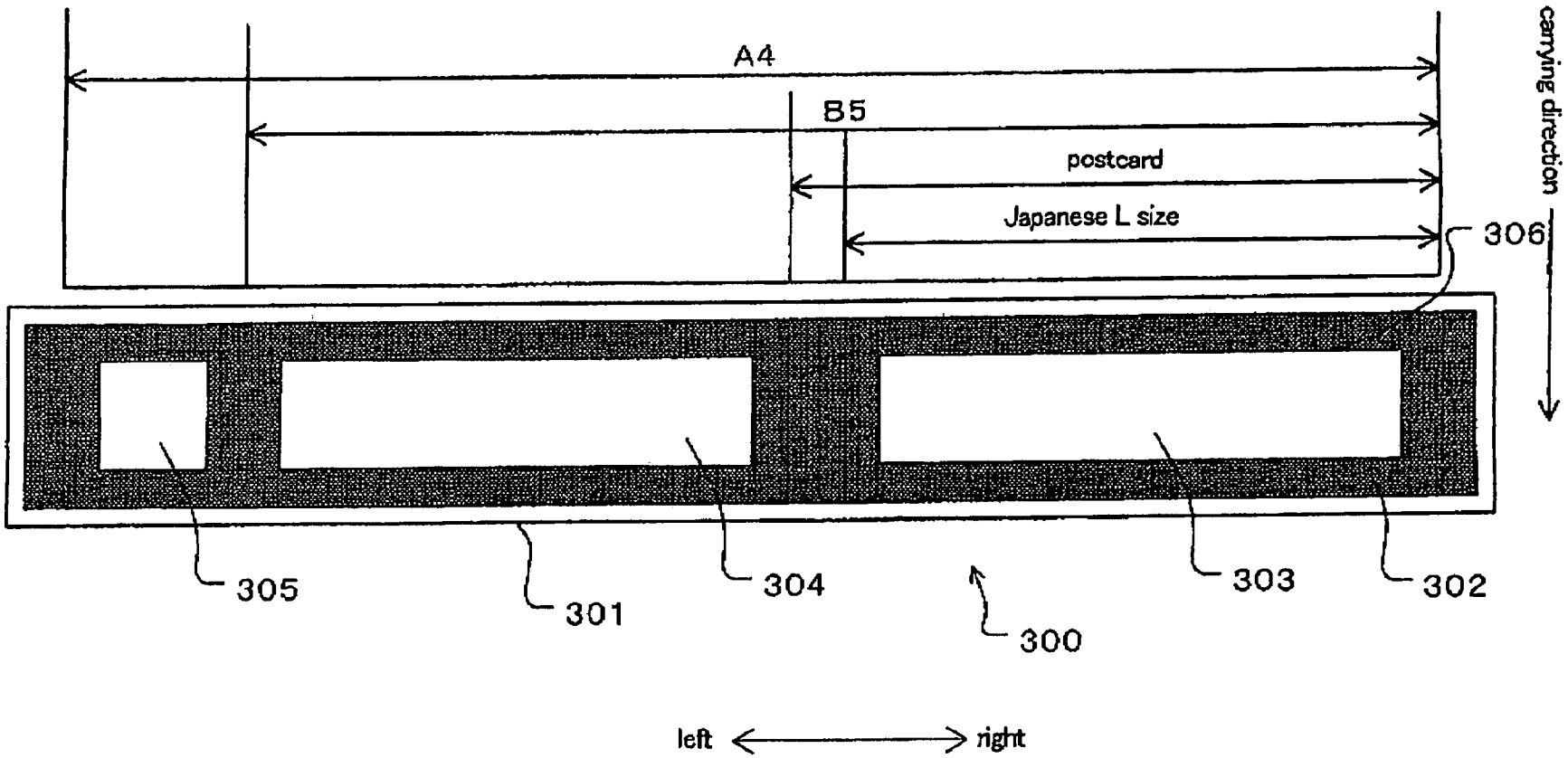
FIG. 6 is a diagram showing the relationship between the platen shown in FIG. 4 and standard sized papers.

FIG. 6 is a diagram showing the relationship between the protruding sections 303 to 305 shown in FIG. 5 and the print paper P.

As shown in this diagram, the size and the position of each of the protruding sections 303 to 305 are determined so that the edge portions of each standard sized paper, such as Japanese L size, postcard, B5, and A4, are positioned above the absorbing material 306. That is, in the case of the Japanese L size, the protruding section 303 is disposed such that the right edge of the paper is over the absorbing material 306 on the right side of the protruding section 303, and the protruding section 303 and the protruding section 304 are arranged such that the left edge of the paper is over the absorbing material 306 between the protruding section 303 and the protruding section 304. The case of the postcard is the same as the case of the Japanese L size. In the case of the B5 paper, the protruding section 303 is disposed such that the right edge of the paper is over the absorbing material 306 on the right side of the protruding section 303, and the protruding section 304 and the protruding section 304 are arranged such that the left edge of the paper is over the absorbing material 306 between the protruding section 304 and the protruding section 305. In the case of the A4 paper, the protruding section 303 is disposed such that the right edge of the paper is over the absorbing material 306 on the right side of the protruding section 303, and the protruding section 305 is disposed such that the left edge of the paper is over the absorbing material 306 on the left side of the protruding section 305. In this manner, when a standard sized paper is used, the protruding sections 303 to 305 are arranged so that the left and right edges of the paper are certainly positioned over the absorbing material 306.

<Regarding the Operation during Normal Printing>

First, a reference example of a printing method for the nozzle array for black is described. This is for the sake of simplifying the description by omitting the description of the nozzle arrays for other colors because the manner in which dots are formed is the same in the cases of the nozzle arrays for other colors.

Figure 7:
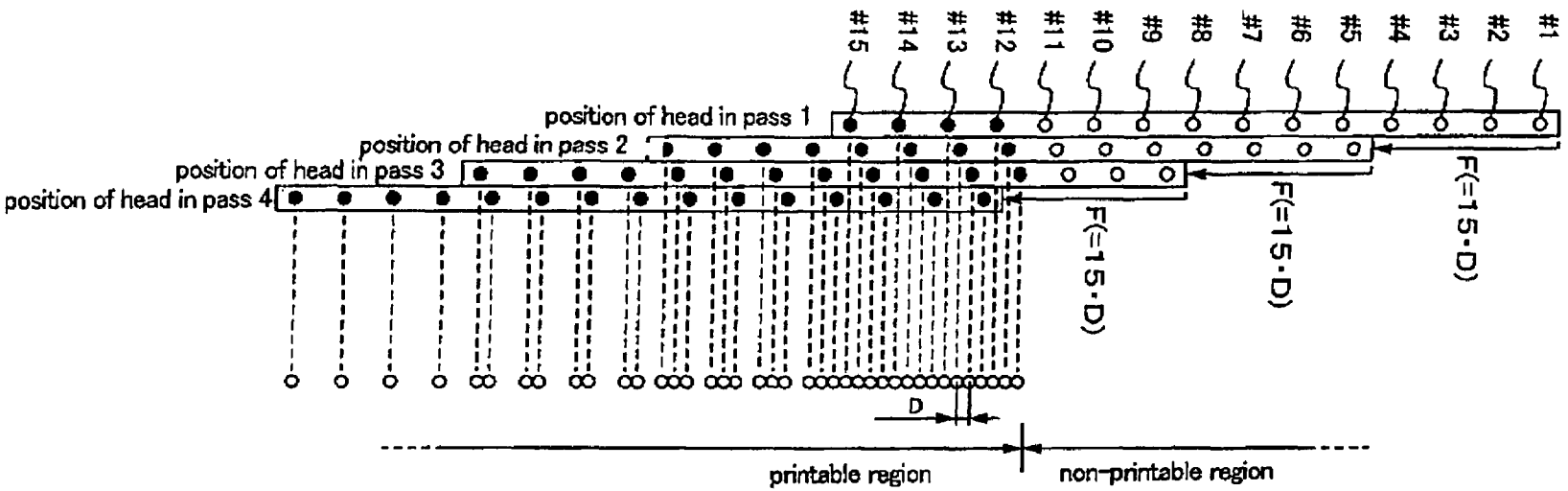
FIG. 7 is an explanatory diagram of a normal printing method.

FIG. 7 is an explanatory diagram of a normal printing method. For convenience sake, the print head (or the nozzle array for black) is illustrated moving with respect to the print paper, but this diagram shows the relative position of the head and the print paper, and in practice the print paper is moved in the carrying direction. Moreover, in this diagram, nozzles shown by solid circles are the nozzles capable of ejecting ink. Nozzles shown by open circles are the nozzles that are set to be incapable of ejecting ink. The positions of the print head (or the nozzle array) in passes 1 to 4 and the manner in which dots are formed are shown in the diagram.

In this printing method, k is 2 or more, and a raster line that is not recorded is sandwiched between the raster lines that are recorded in a single pass. Here, "pass" refers to a single movement in which the nozzles are moved in the movement direction. "Raster line" is a row of pixels lined up in the movement direction, and also referred to as a scan line. Moreover, "pixels" are square grids that are determined in a virtual manner in order to define the positions where ink droplets are made to land so as to record dots.

In this printing method, each time the print paper is carried by a constant carry amount F in the carrying direction, each nozzle records a raster line immediately above the raster line that was recorded in the previous pass. In order to perform recording while keeping the carry amount constant in this manner, the number N (integer) of nozzles capable of ejecting ink and k are coprime, and the carry amount F is set to N·D.

In this diagram, the nozzle array has 15 nozzles arranged along the carrying direction. Since k is 4, the condition for performing this printing method, that is, "N and k are coprime", is satisfied. Moreover, since 15 nozzles are used, the print paper is carried using a carry amount of 15·D. As a result, dots are formed on the print paper with a dot spacing of 720 dpi (=D) using a nozzle array having a nozzle pitch of 180 dpi (4·D).

This diagrams shows the manner in which continuous raster lines are formed, with the first raster line being formed by the nozzle #4 in the pass 3, the second raster line being formed by the nozzle #8 in the pass 2, the third raster line being formed by the nozzle #12 in the pass 1, and the fourth raster line being formed by the nozzle #1 in the pass 4. It should be noted that only nozzles upstream of the nozzle #12 in the carrying direction eject ink in the pass 1 and only nozzles upstream of the nozzle #8 in the carrying direction eject ink in the pass 2. The reason for this is that even if ink is ejected from all of the nozzles in the pass 1 and the pass 2, continuous raster lines cannot be formed on the print paper. In the pass 4 and thereafter, the 15 nozzles (#1 to #15) eject ink, and the print paper is carried by a constant carry amount F (=15·D), and thus continuous raster lines are formed with a dot spacing of D.

In practice, the number of nozzles is 180. When the number of nozzles is 180, ink is ejected from 179 nozzles and the print paper is carried using a carry amount of $^{179}/_{720}$ inch (=179·D) in normal print processing. Thus, dots can be formed at a resolution of $^{1}/_{720}$ inch (=D) by the nozzle array at a nozzle pitch of $^{1}/_{180}$ inch.

Configuration of the Computer

Next, a configuration of the computer 90 is described with reference to FIG. 8.

Figure 8:
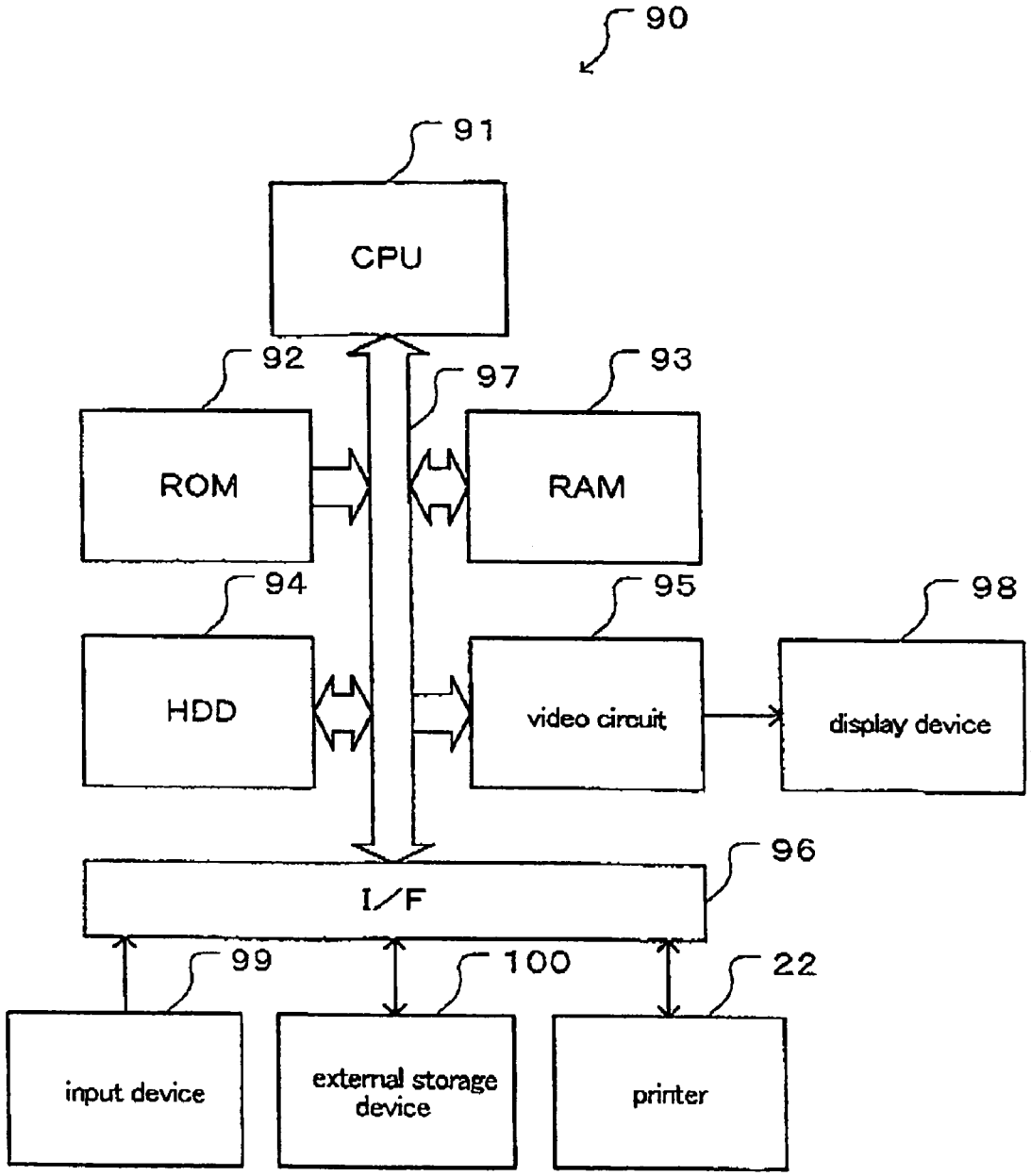
FIG. 8 is a block diagram showing a detailed configuration example of a computer shown in FIG. 1.

As shown in FIG. 8, the computer 90 is constituted by a cpu 91, a ROM 92, a RAM 93, a HDD (Hard Disk Drive) 94, a video circuit 95, an interface 96, a bus 97, a display device 98, an input device 99, and an external storage device 100.

Here, the CPU 91, which is a detecting means and a determining means, executes various types of arithmetic processing according to a program stored in the ROM 92 and the HDD 94, and also serves as a controller for controlling the components of the apparatus.

The ROM 92 is a memory that stores basic programs to be executed by the CPU 91 and data. The RAM 93 is a memory for temporarily storing the program being executed by the CPU 91 and the data being calculated, for example.

The HDD 94 is a recording device for reading data or programs recorded on a hard disk, which is a storage medium, in accordance with a request from the CPU 91, and also for recording data generated as a result of the arithmetic processing in the CPU 91 on the above-described hard disk.

The video circuit 95 is a circuit for performing drawing processing in accordance with a drawing instruction supplied from the CPU 91 and converting the resultant image data into video signals for output to the display device 98.

The interface 96 is a circuit for converting the form of signals output from the input device 99 and the external storage device 100, as appropriate, and also for outputting print data PD to the printer 22.

The bus 97 is a signal line for interconnecting the CPU 91, the ROM 92, the RAM 93, the HDD 94, the video circuit 95, and the interface 96 so as to enable transfer of data among them.

The display device 98, which is constituted by an LCD (Liquid Crystal Display) monitor or a CRT (Cathode Ray Tube) monitor, for example, is a device for displaying an image corresponding to the video signals output from the video circuit 95.

The input device 99, which is constituted by a keyboard or a mouse, for example, is a device for generating signals in accordance with operation by a user and supplying these signals to the interface 96.

The external storage device 100, which is constituted by a CD-ROM (Compact Disk-ROM) drive unit, a MO (Magneto Optic) drive unit, or a FDD (Flexible Disk Drive) unit, for example, is a device for reading data or a program recorded on a CD-ROM disk, a MO disk, or a FD and supplying this to the CPU 91. Moreover, when it is a MO drive unit or a FDD unit, it is a device for recording data supplied from the CPU 91 on a MO disk or a FD.

Figure 9:
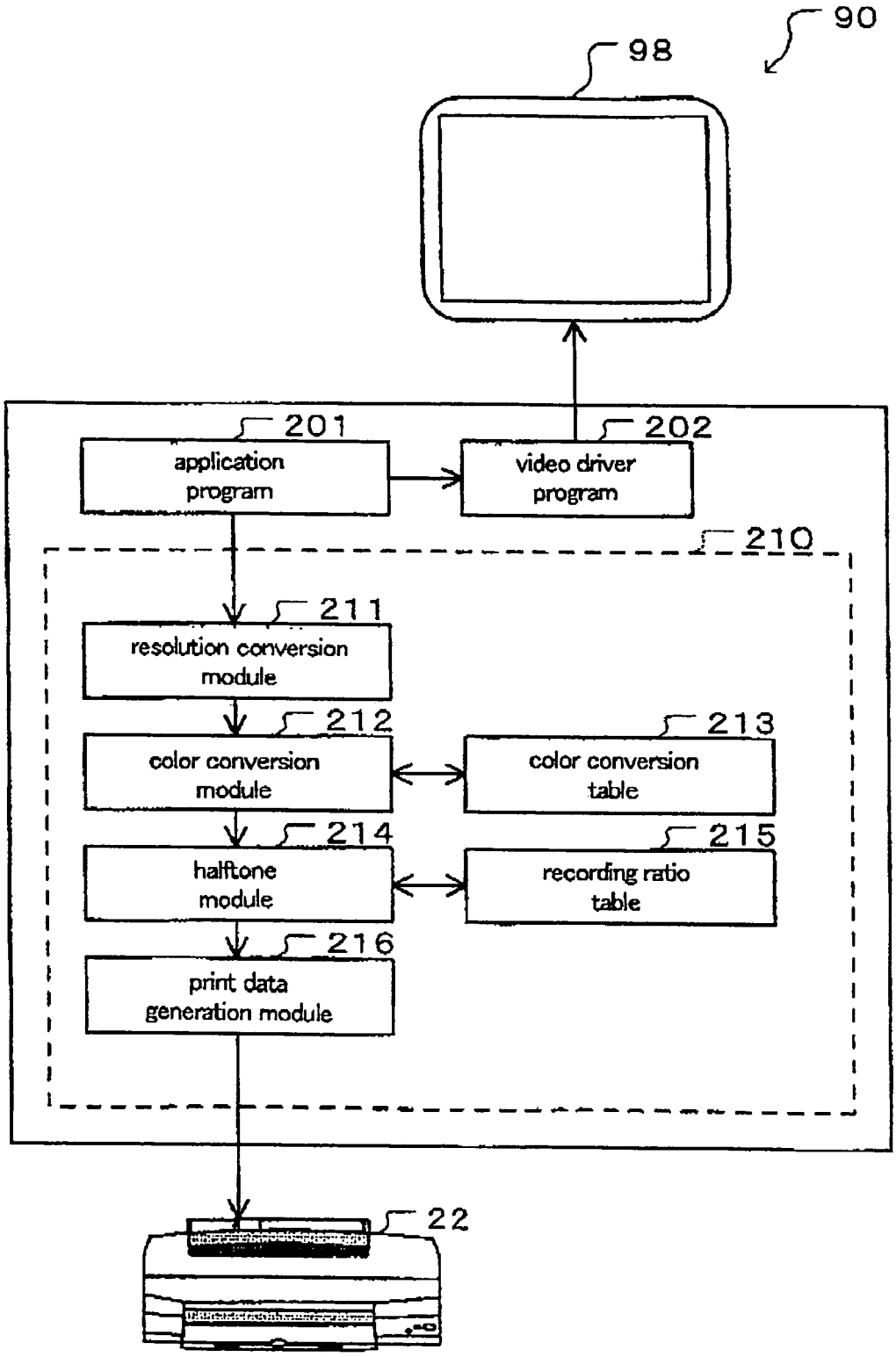
FIG. 9 is a diagram showing an example of a processing function implemented through cooperation between hardware and software of the computer shown in FIG. 8.

FIG. 9 is a diagram for describing the functions of programs and drivers installed on the computer 90. It should be noted that these functions are implemented by cooperation between hardware of the computer 90 and software recorded on the HDD 94. As shown in this diagram, an application program 201, a video driver program 202, and a printer driver program 210 are installed on the computer 90, and these programs operate under a predetermined operating system (OS).

Here, the application program 201, which is an image processing program, carries out, for example, processing of images captured from a digital camera and the like or processing of images drawn by a user, and then outputs these images to the printer driver program 210 and the video driver program 202.

The video driver program 202 is a program for driving the video circuit 95, and, for example, carries out gamma processing, white balance adjustment, etc. with respect to the image data supplied from the application program, and then generates video signals and supplies these signals to the display device 98 for display.

The printer driver program 210 is constituted by a resolution conversion module 211, a color conversion module 212, a color conversion table 213, a halftone module 214, a recording ratio table 215, and a print data generation module 216, and performs various types of processing described below with respect to the image data generated by the application program 201 to generate print data PD and supplies this to the printer 22.

Here, the resolution conversion module 211 carries out processing of converting the resolution of the image data supplied from the application program 201 in accordance with the resolution of the print head 12.

The color conversion module 212 carries out processing of converting the image data expressed in the RGB (Red, Green, Blue) color system into image data of the CMYK (Cyan, Magenta, Yellow, Black) color system by referencing the color conversion table 213.

The halftone module 214 references the recording ratio table 215 and converts the image data expressed in the CMK color system into bitmap data made of combinations of three different types of dots, that is, large, medium, and small dots, by dithering as described later.

The print data generation module 216 generates print data PD that contains raster data indicating the manner in which dots are recorded during each main scan and data indicating the carry amount (sub-scan feed amount) from the bitmap data output from the halftone module 214, and supplies the print data PD to the printer 22.

Processing During Printing

Figure 10:
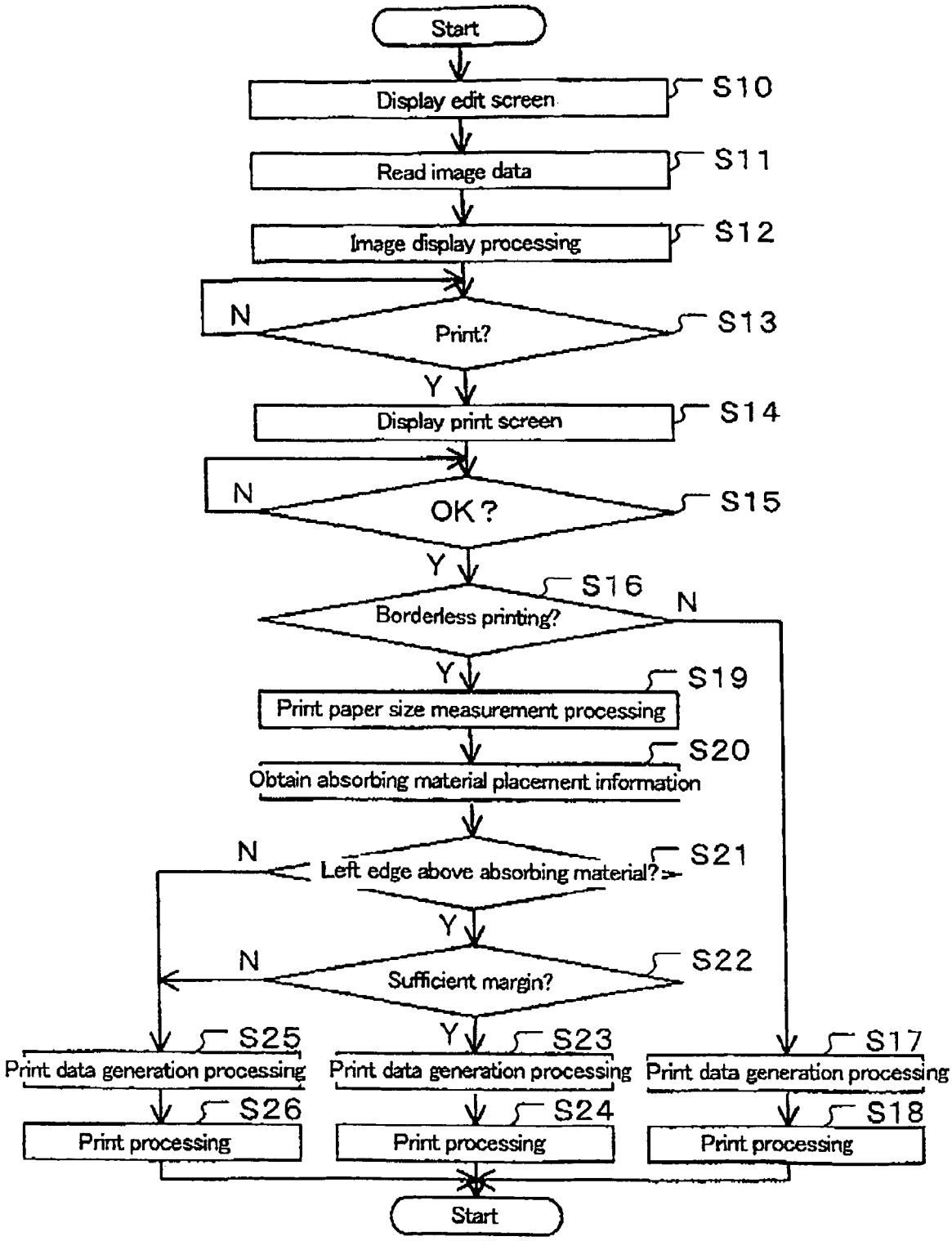
FIG. 10 is a flowchart for describing an example of processing that is performed in the printing apparatus shown in FIG. 1 when printing an image.

Next, processing in the case where printing of image data is executed by the computer 90 shown in FIG. 1 is described with reference to FIG. 10. The processing shown in FIG. 10 is executed when a predetermined image data (image file) stored in the HDD 94 is designated through the input device 99 and the application program 201 associated with that image data is activated. When the procedure of this flowchart is started, the following steps are performed.

<Processing Before the Start of Printing (Steps S10 to S16)>

Step S10: The application program 201 obtains information for displaying an edit screen of the application program 201 from the HDD 94, and supplies the information to the video circuit 95. Consequently, a screen 250 as shown in FIG. 11 is displayed on the display device 98.

Figure 11:
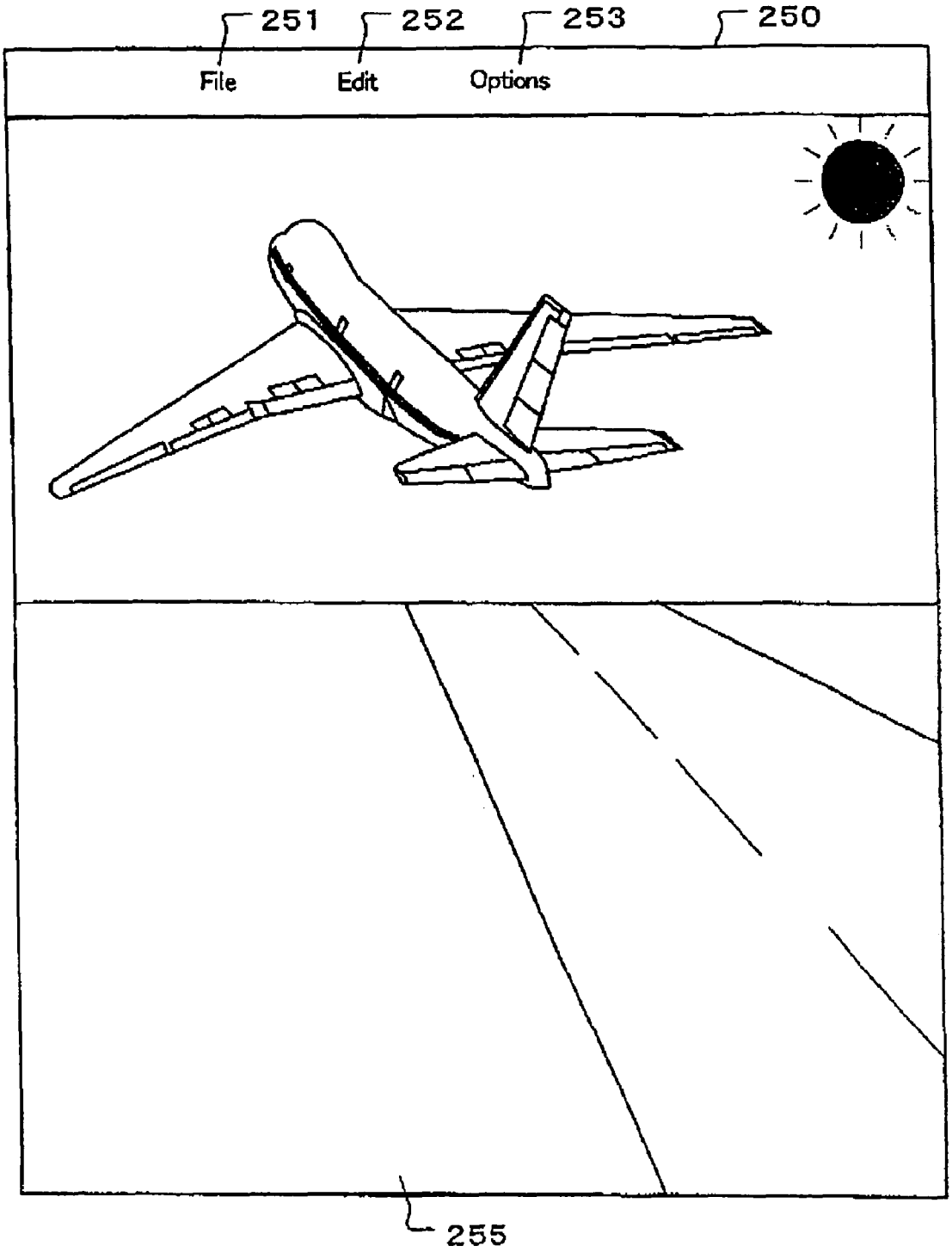
FIG. 11 is an example of a screen that is displayed on a display device shown in FIG. 8 when the flowchart shown in FIG. 10 is performed.

In a display example shown in FIG. 11, File 251, Edit 252, and Options 253 are displayed as menus on the top of the screen 250. Moreover, below the menus, there is a display region 255 where an image subjected to editing is displayed. In this example, the image is displayed in the display region 255, but in practice an image is not displayed at the point of time when the processing of step S10 is finished.

Step S11: The application program 201 reads out from the HDD 94 the image data that was designated when the application program 201 was activated.

Step S12: The application program 201 displays the image data that was read out in step s11 in the display region 255. Consequently, for example, an image photographed by a digital camera and the like is displayed in the display region 255 as shown in FIG. 11.

Figure 12:
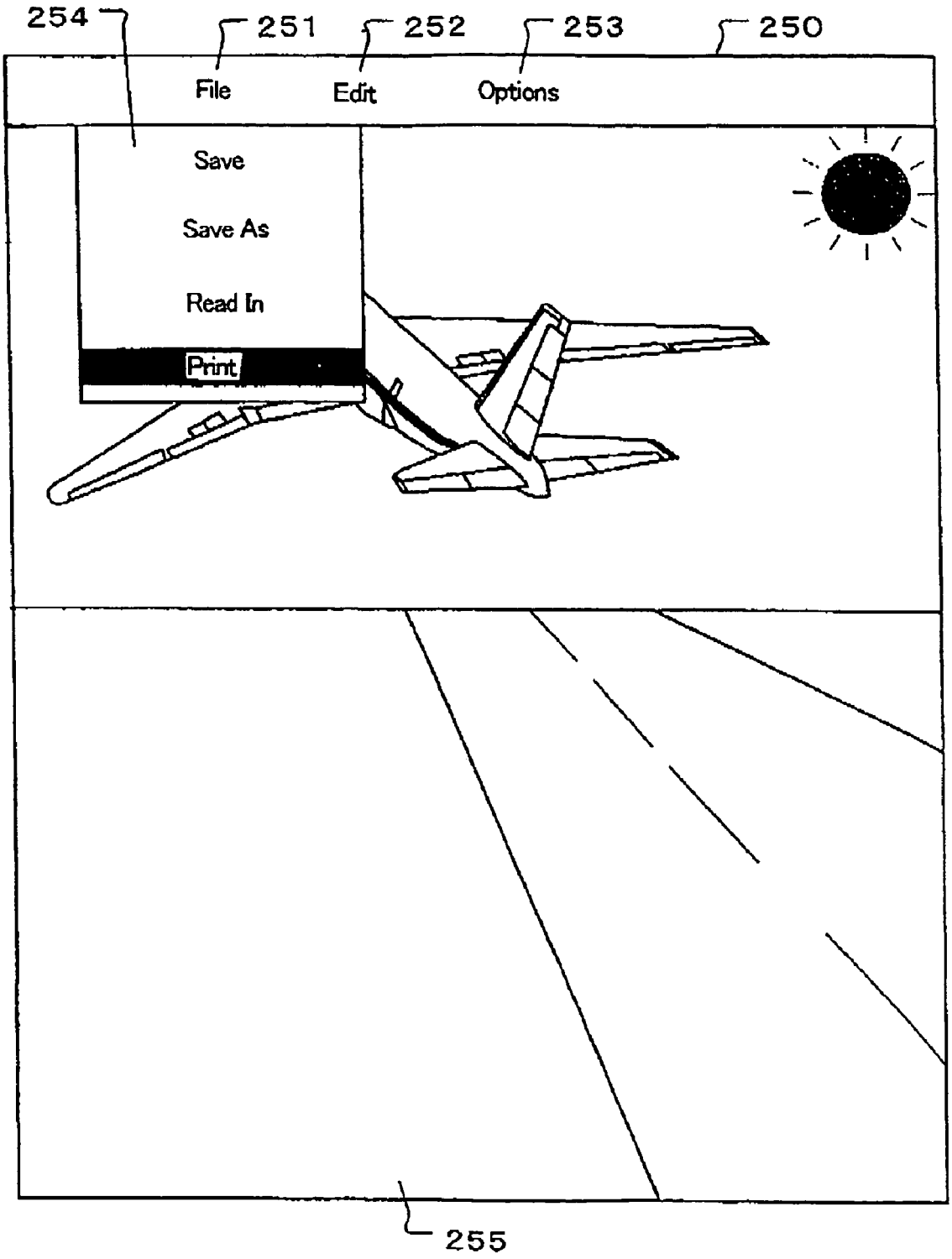
FIG. 12 is an example of a pull-down menu that is displayed when "File", which is a menu, in the screen shown in FIG. 11 is operated.

Step S13: The application program 201 determines whether or not an operation for printing the image being displayed in the display region 255 was performed. Specifically, it determines whether or not "Print" was selected from a pull-down menu 254 that is displayed when File 251 is operated, as shown in FIG. 12, and if "Print" was selected, then the procedure goes to step S14, and otherwise the same processing is repeated.

Figure 13:
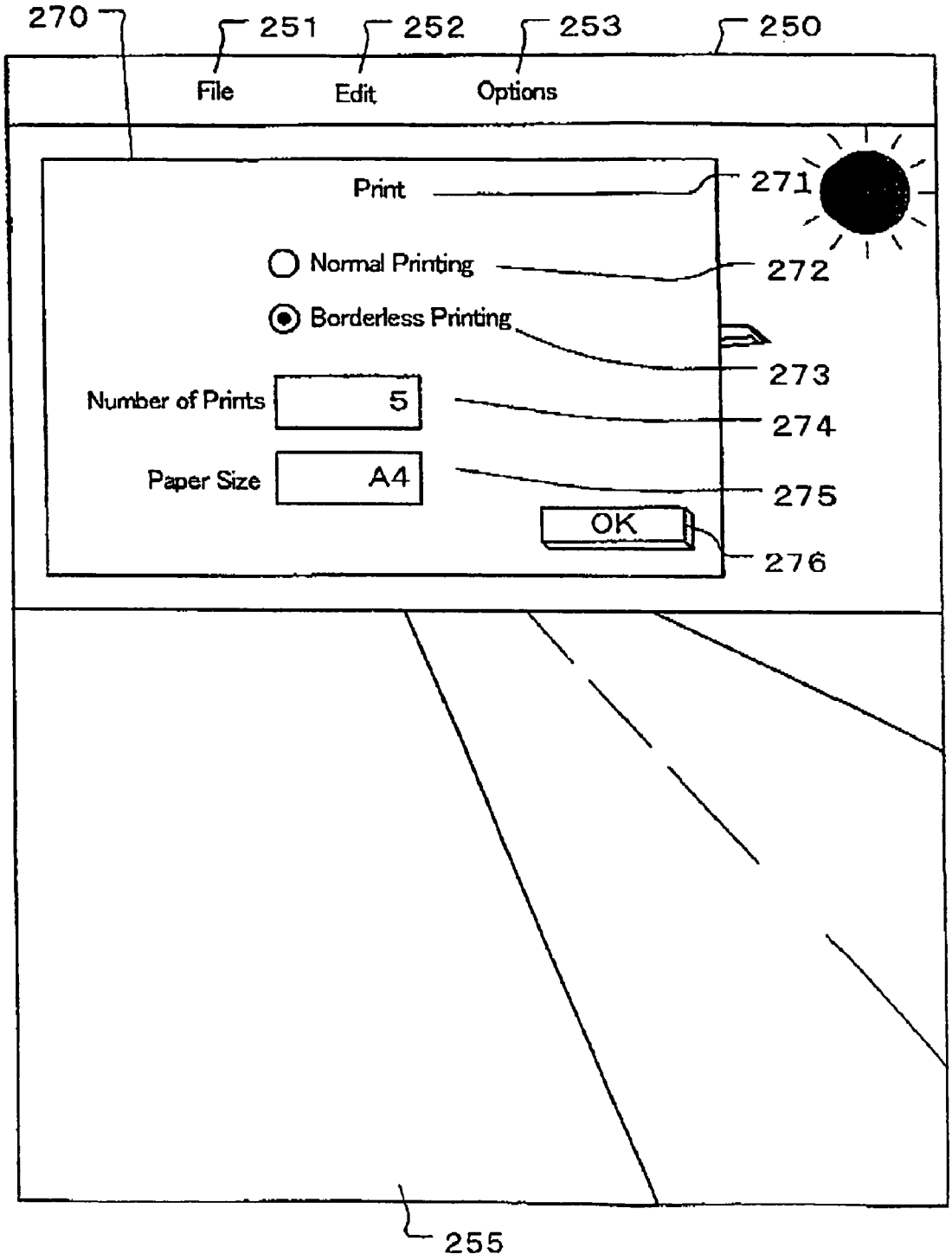
FIG. 13 is an example of a screen that is displayed when "print" in the pull-down menu shown in FIG. 12 is selected.

Step S14: The application program 201 accesses the printer driver program 210, and the printer driver program 210 makes the display device 98 display a print screen. Consequently, a new screen 270 as shown in FIG. 13 is displayed on the display device 98.

In this display example, a title 271, radio buttons 272 and 273, text boxes 274 and 275, and a button 276 are displayed on the screen 270. Here, "Print", which is the title 271, indicates that this screen 270 is a screen for printing. The radio button 272 is selected when normal printing is to be performed. The radio button 273 is selected when borderless printing is to be performed. Here, "borderless printing" is intended to include the cases where printing is performed such that no borders are formed at any of the top and bottom and the left and right edges of the print paper P and where printing is performed such that no borders are formed at the left and right edges.

The text box 274 is where the number of sheets to print the image is input. The text box 275 is where the size of the print paper (e.g., A4 or B5) is input. The button 276 is operated when print processing according to the inputs is to be started.

Step S15: The printer driver program 210 determines whether or not the button 276 shown in FIG. 13 was operated, and when it was operated, the procedure goes to step S16, and otherwise the same processing is repeated.

Step S16: The printer driver program 210 determines whether or not borderless printing is to be performed. That is, the printer driver program 210 determines whether or not the radio button 273 in FIG. 13 is selected, and when it is selected, the procedure goes to step S19, and otherwise the procedure goes to step S17.

<Processing of Normal Printing (Steps S17 to S18)>

Step 17: The application program 201 supplies the image data to the printer driver program 210, and the printer driver program 210 starts processing for generating print data PD for performing the processing of normal printing.

Step S18: The printer driver program 210 performs resolution conversion, dithering, etc. with respect to the image data (image data expressed in the RGB color system) supplied from the application program 201 to generate print data PD, and supplies the print data PD to the printer 22. In the printer 22, the print head 12 is driven in the movement direction and ink is ejected from the print head 12 in accordance with the received print data PD so as to form raster lines on a print paper P (this operation is also referred to as "scan" or "main scan"). Then, after a single pass has been finished, the print paper is carried by a predetermined carry amount (this operation is also referred to as "sub scan"), and the same processing is repeated, thereby printing the image in a predetermined area (an area within the print paper P) on the print paper P. Consequently, the processing of normal printing is completed.

As already described, when the number of nozzles is 15, ink is ejected from all of the nozzles (15 nozzles) and the print paper is carried using a carry amount of $^{15}/_{720}$ inch (=15·D) in the processing of normal printing. Thus, dots can be formed at a resolution of $^{1}/_{720}$ inch (=D) by the nozzle array with a nozzle pitch of $^{1}/_{180}$ inch in practice, the number of nozzles is 180, so that ink is ejected from 179 nozzles and the print paper is carried using a carry amount of $^{179}/_{720}$ inch (179·D).

<Preprocessing for Processing of Borderless Printing (Steps S19 to S22)>

Figure 14:
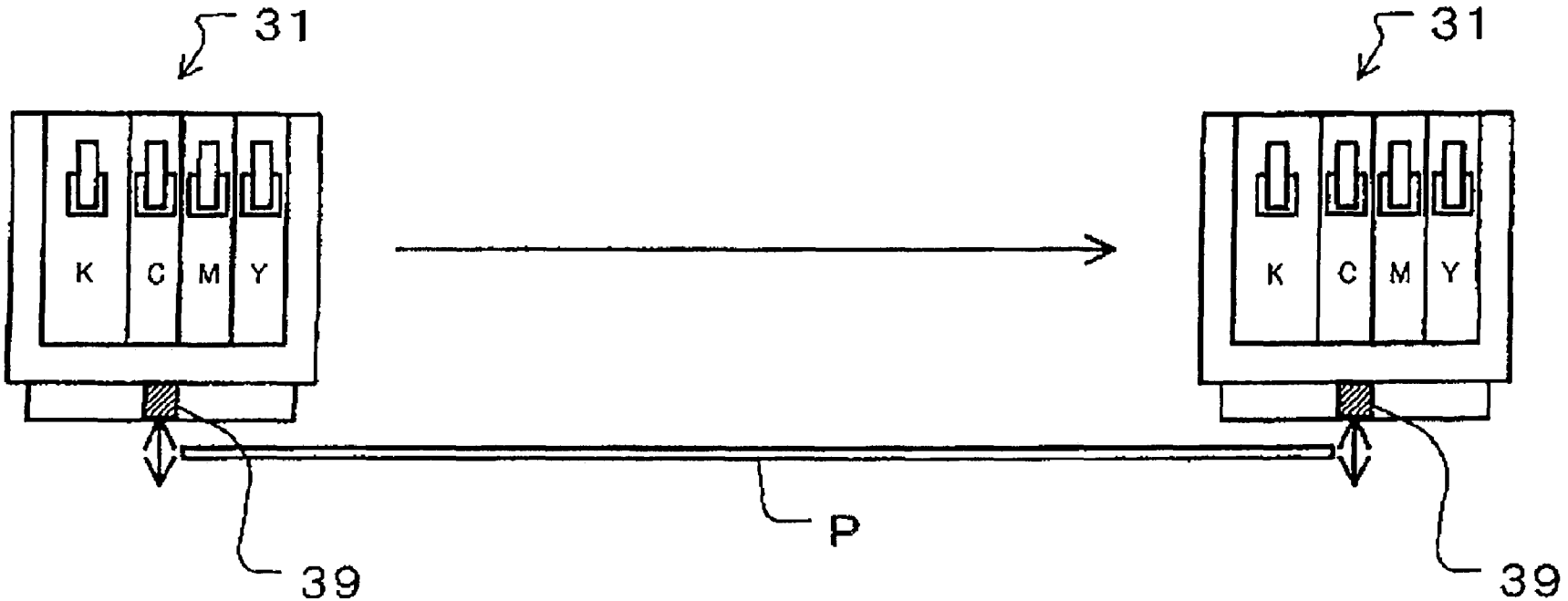
FIG. 14 is a diagram for describing the operation of a carriage when detecting the width, in the movement direction, of the print paper in the printer shown in FIG. 1.

Step S19: When the radio button 273 is selected, the procedure moves to this step, and the printer driver program 210 requests the printer 22 to measure the size of the print paper P in the movement direction. Consequently, the printer 22 carries (picks up) a piece of print paper P, and moves the carriage 31 so as to first detect the left edge, for example, of the print paper P as shown in FIG. 14. At this time, the optical sensor 39 detects the reflected light from the left edge of the print paper P and also obtains the position at that time from the encoder 47. Next, as shown in FIG. 14, the print head 12 is moved to the right edge, and the optical sensor 39 detects the right edge of the print paper P and also obtains the position at that time from the encoder 47. Then, the size (length) of the print paper P in the movement direction is found by referencing the positional information of the left edge and the right edge of the print paper P obtained from the encoder 47.

Step S20: The printer driver program 210 obtains placement information of the absorbing material 306 (see FIGS. 4 and 5) from the printer 22. It should be noted that the "placement information of the absorbing material 306" refers to information indicating the position where the absorbing material 306 is present.

Figure 15:
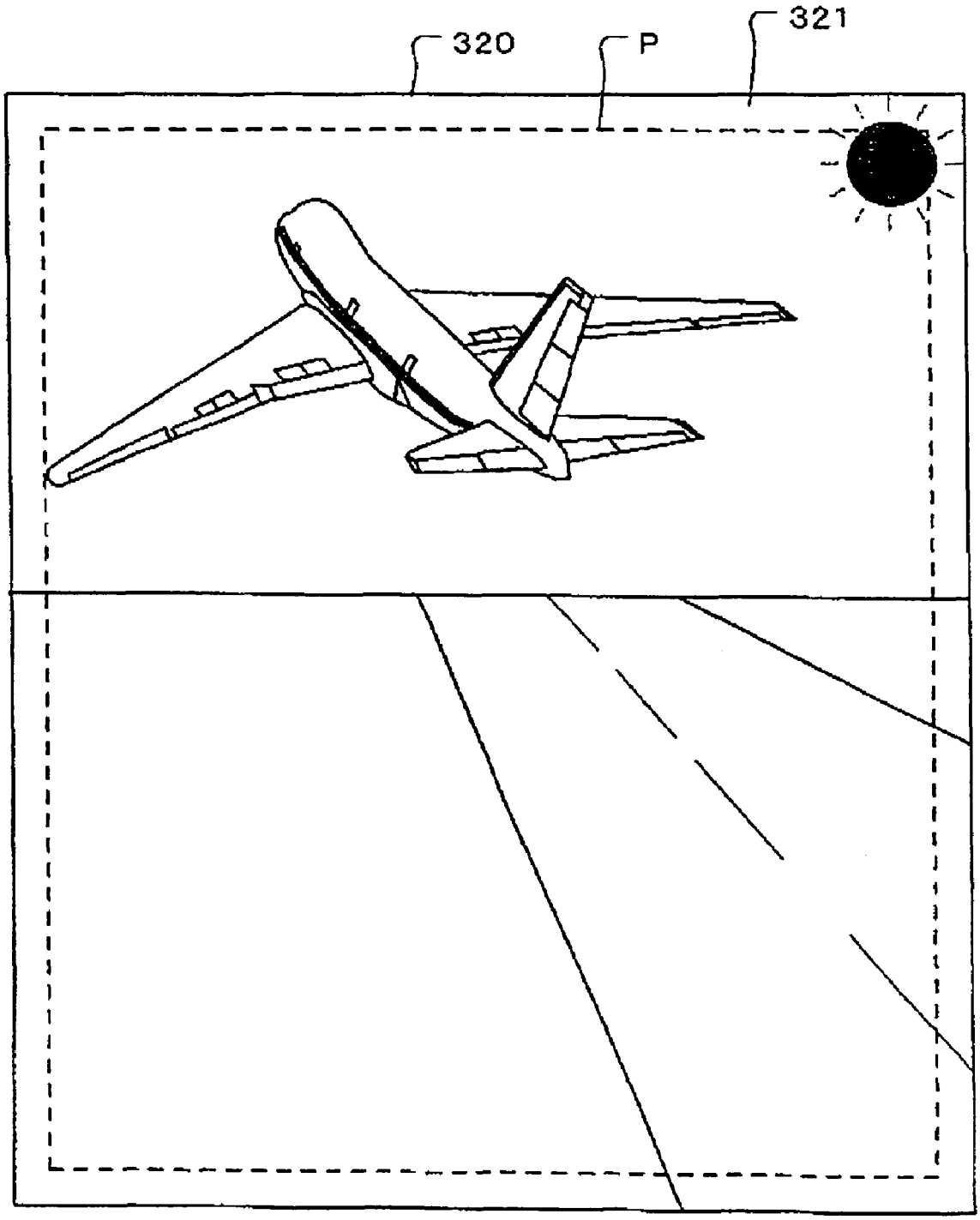
FIG. 15 is a diagram showing the relationship of the print paper, image data, and an outside region in the printing apparatus shown in FIG. 1.
Figure 16:
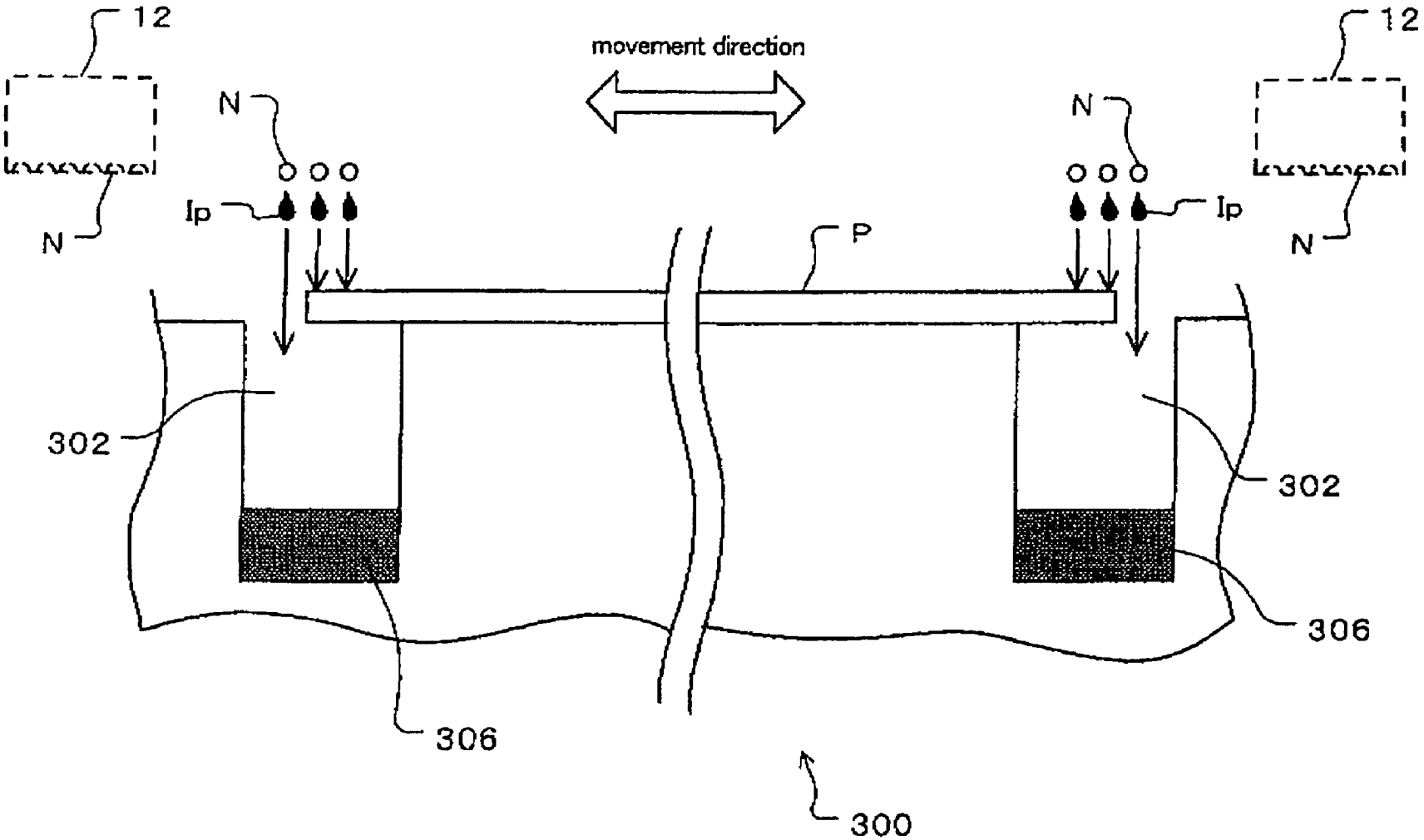
FIG. 16 is a diagram showing the relationship of the print head, the print paper, and the platen in the printing apparatus shown in FIG. 1, for describing the manner in which printing is performed with ink landing outside a left and a right edge of the print paper.

In the case of borderless printing, in order to prevent borders from being formed at the edge portions of the print paper P, image data 320 is printed so as to extend beyond the print paper P, as shown in FIG. 15. That is, in the case of borderless printing, ink is ejected to a region 302 larger than the print paper P, as shown in FIG. 15. Thus, ink droplets that are ejected in correspondence with an outside portion 321 that lies outside the print paper P do not land on the print paper P. The ink droplets Ip corresponding to the outside portion 321 are absorbed by the absorbing material 306, as shown in FIG. 16. Therefore, it is possible to prevent the ink droplets Ip from adhering to the protruding sections 303 to 305 and thus making them dirty. Here, FIG. 16 is a diagram showing the manner in which printing is performed at the left and right edge portions of the print paper P. The recessed section 302 is provided so as to be longer than the left to right width of the print paper P having the largest size (in this example, A4 paper).

Figure 17:
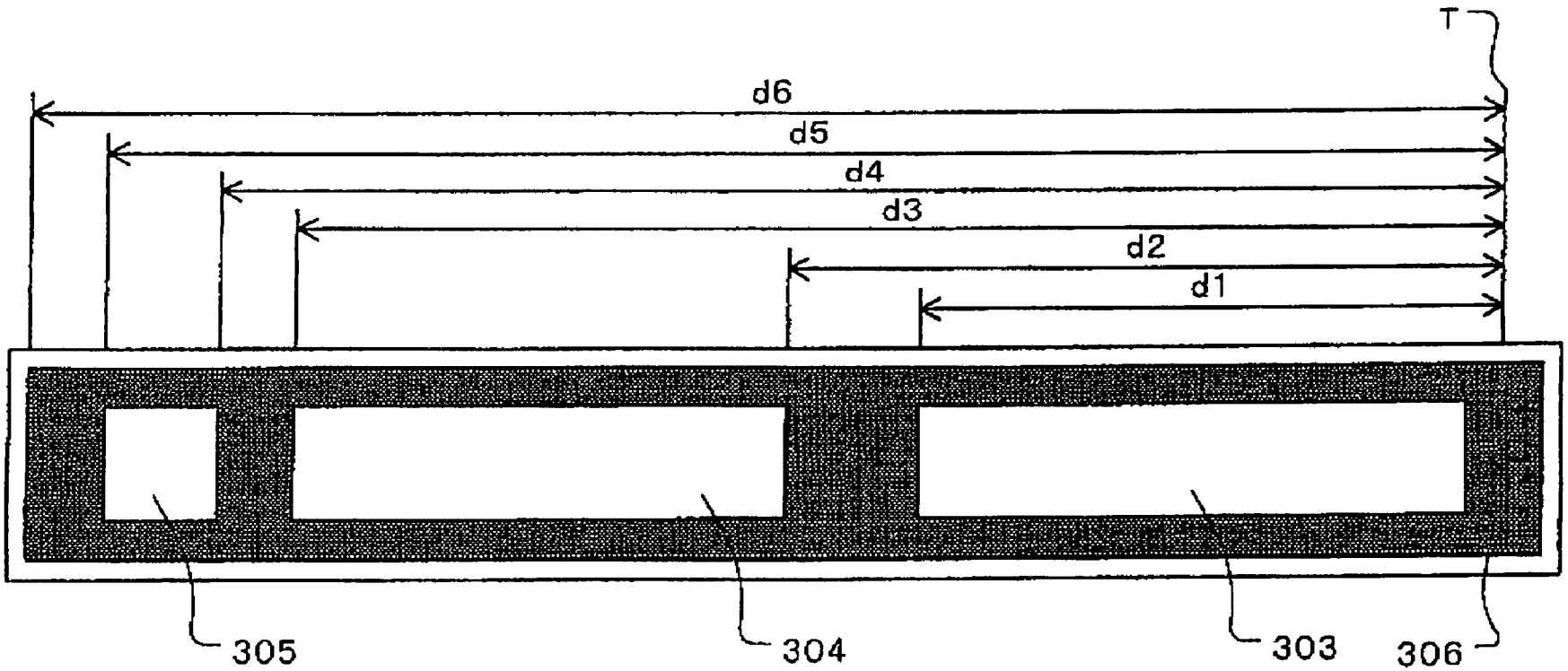
FIG. 17 is a diagram showing an example of placement information of an absorbing material that is disposed in the platen shown in FIG. 4.

It should be noted that the "placement information of the absorbing material 306" mentioned in step S20 refers to information of the widths d1 to d6 in the case where a position T over which the right edge of the print paper P passes is used as the reference, as shown in FIG. 17. The width d1 is a distance from the position T to the left end of the protruding section 303. The width d2 is a distance from the position T to the right end of the protruding section 304. Moreover, the width d3 is a distance from the position T to the left end of the protruding section 304. The width d4 is a distance from the position T to the right end of the protruding section 305. The width d5 is a distance from the position T to the left end of the protruding section 305. The width d6 is a distance from the position T to the left end of the frame 301. By referencing these widths d1 to d6, it is possible to determine whether or not the left and right edges of the print paper P come over the absorbing material 306 when the print paper P is a non-standard sized paper. The placement information about the widths d1 to d6 is stored in the P-ROM 43 of the printer 22, for example, and the printer driver program 210 can obtain the placement information by requesting the printer 22 to send the placement information.

Let us return to FIG. 10. When the processing of step S20 has been finished, the procedure goes to step S21.

Figure 18:
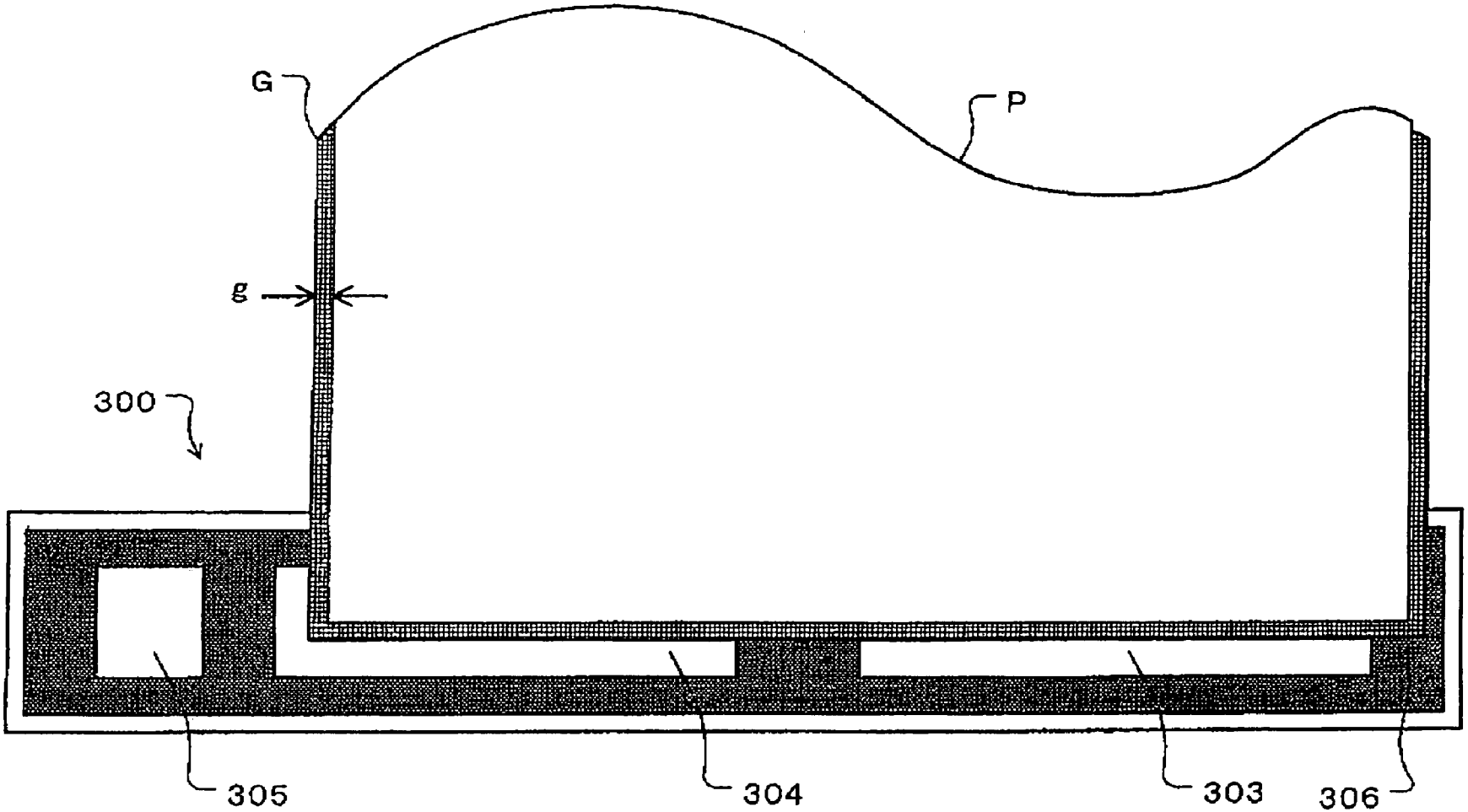
FIG. 18 is a diagram showing the positional relationship in the case where the portion of the image data that lies outside the print paper is not aver the absorbing material in the printing apparatus shown in FIG. 1.

Step S21: The printer driver program 210 performs a comparison between the information about the size of the print paper P, which was obtained in step S19, and the placement information of the absorbing material 306, which was obtained in step S20, and determines whether or not the left edge of the print paper P is positioned over the absorbing material 306 (i.e., determines whether or not the left edge of the print paper P is positioned on the protruding section). Specifically, when the length of the print paper P in the left to right direction is w and the width of image data G to be printed so as to extend beyond the print paper P is g (see FIG. 18), and when d1<W<d2, for example, it is determined that the left edge of the print paper P is positioned over the absorbing material 306 (above the absorbing material 306 between the protruding section 303 and the protruding section 304), and the procedure goes to step S22. Moreover, when d2<W<d3, for example, ink that has landed outside the left edge of the print paper P is positioned on the protruding section 304 instead of being positioned above the absorbing material 306, as shown in FIG. 18, so that the procedure goes to step S25.

Figure 19:
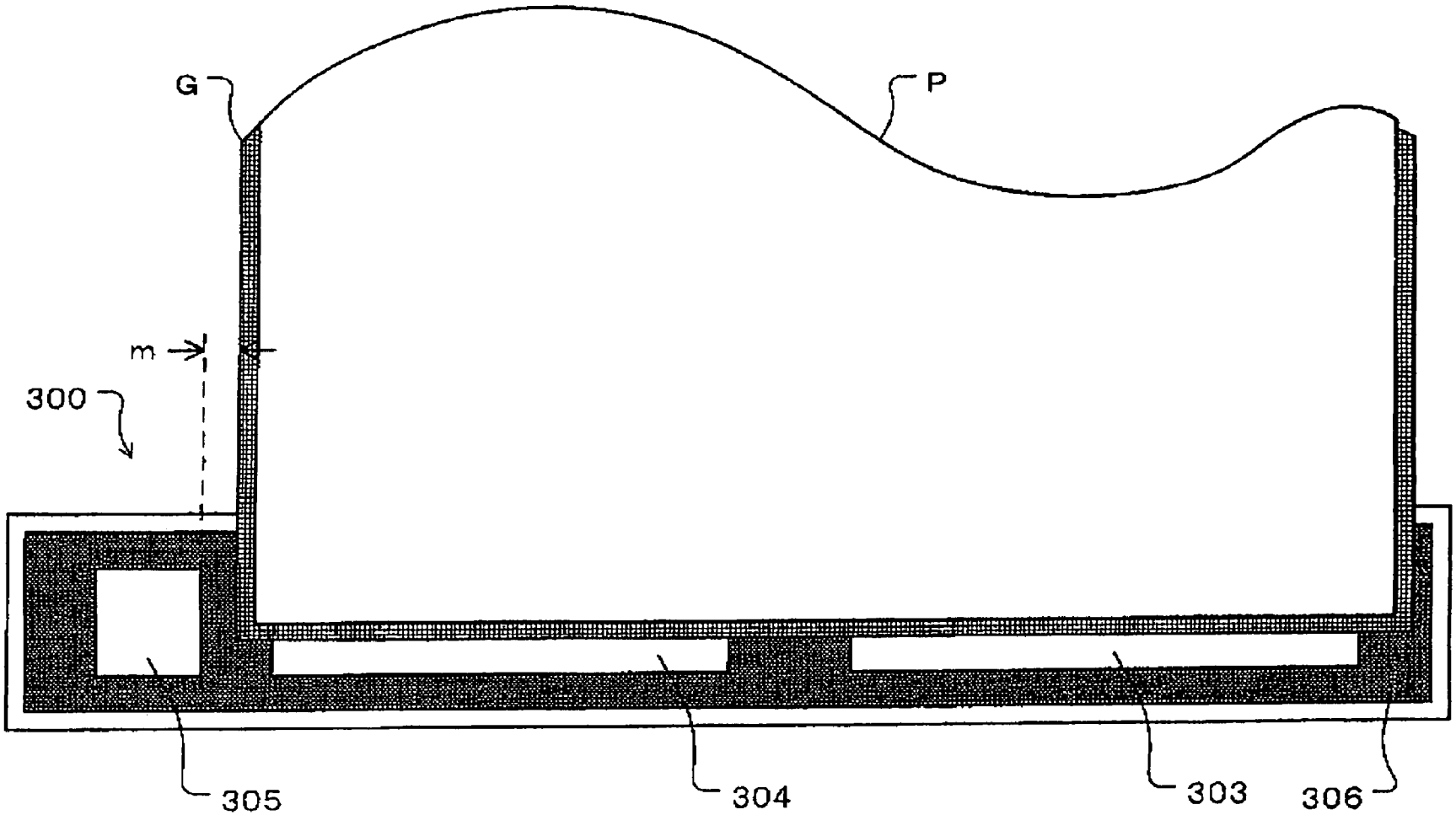
FIG. 19 is a diagram showing the positional relationship in the case where the portion of the image data that lies outside the print paper is over the absorbing material and the distance from a protruding section is sufficient in the printing apparatus shown in FIG. 1.
Figure 20:
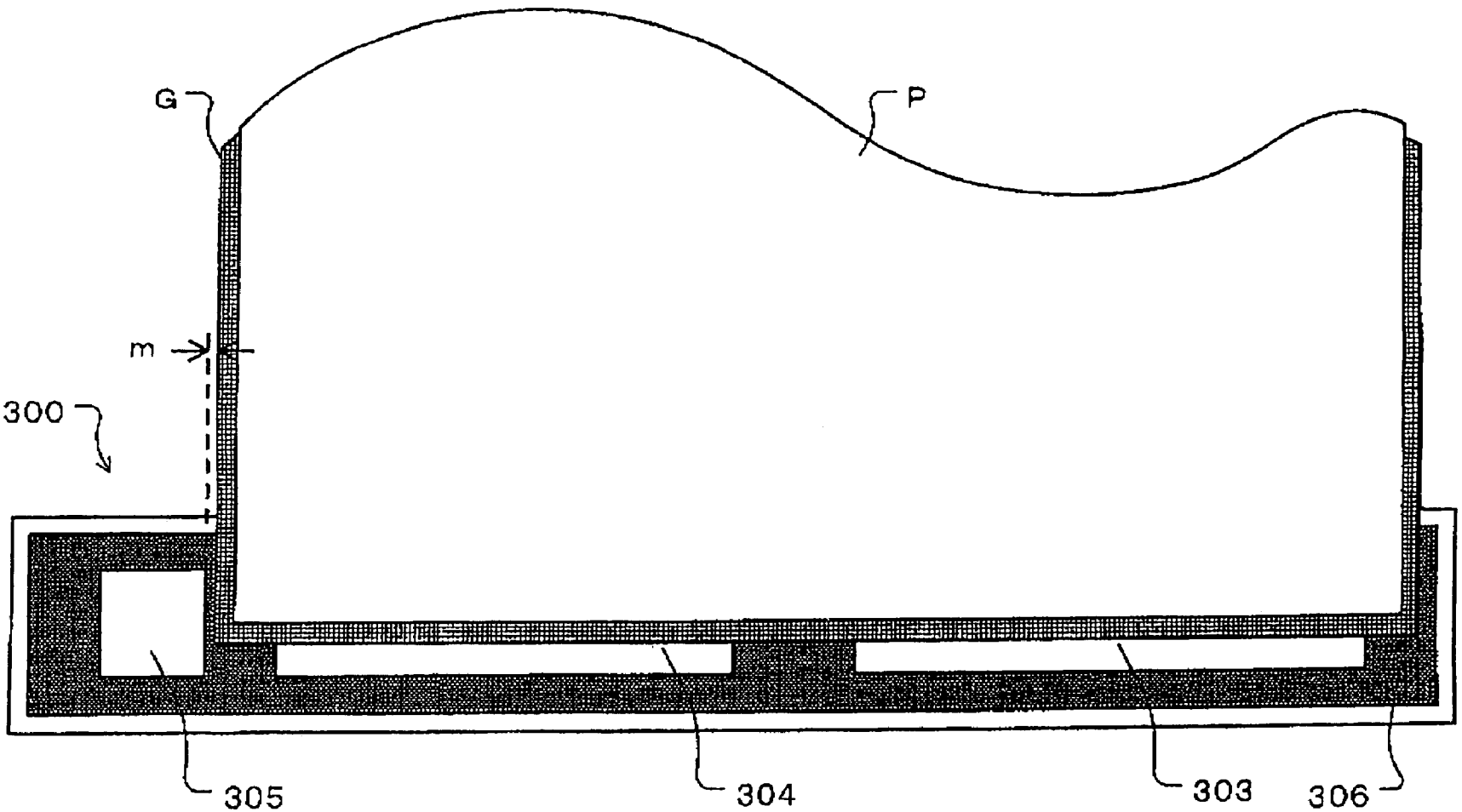
FIG. 20 is a diagram showing the positional relationship in the case where the portion of the image data that lies outside the print paper is over the absorbing material and the distance from the protruding section is not sufficient in the printing apparatus shown in FIG. 1.

Step S22: The printer driver program 210 determines whether or not a margin between the image data and the protruding sections 303 to 305 is sufficient. That is, as shown in FIG. 19, when the distance (margin) m between the left edge of the image data G that lies outside the left edge of the print paper P and the protruding section 305 that is on the left side of the image data G is equal to or larger than a predetermined distance, it is determined that the margin is sufficient, and the procedure goes to step S23. On the other hand, as shown in FIG. 20, when the distance (margin) m between the left edge of the image data G that lies outside the left edge of the print paper P and the protruding section 305 that is on the left side of the image data G is less than a predetermined distance, ink may adhere to the protruding section 305, so that it is determined that the margin is not sufficient, and the procedure goes to step S25. It should be noted that when the width of the image data G to be printed so as to extend beyond the print paper P is g (see FIG. 18), the margin m is calculated based on the placement information, the length W of the print paper P in the left to right direction, and the width g.

<Processing of Normal Borderless Printing (Steps S23 and S24)>

Step S23: The application program 201 passes the image data to the printer driver program 210, and requests it to generate print data PD. Consequently, resolution conversion, dithering, etc. are performed to generate print data PD having a size larger than the size of the print paper P by a predetermined amount, which is then supplied to the printer 22, and thus the processing of normal borderless printing is performed.

Figure 21:
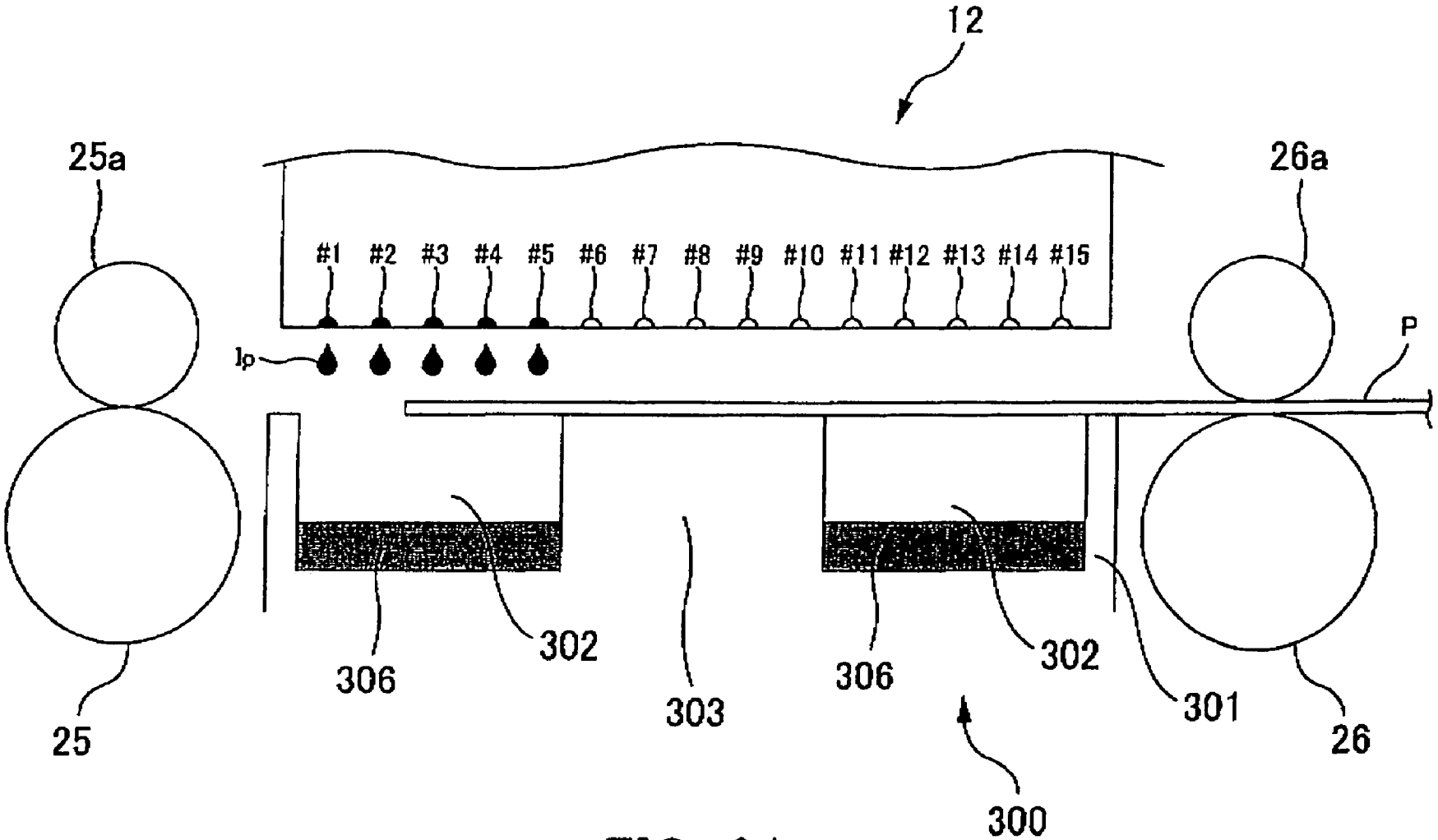
FIG. 21 is an explanatory diagram of top edge processing during processing of normal borderless printing.

When printing is started, the printer 22 first feeds (picks up) the print paper P so as to transport this to a position under the nozzles #1 to #5 shown in FIG. 21. That is, when the print paper P is fed, the top edge of the print paper P is positioned over the recessed section 302, that is, between the recessed section 302 and the nozzles #1 to #5. Then, ink is ejected from the nozzles #1 to #5 to perform a processing (top edge processing) of printing the image on the top edge of the print paper P. At this time, ink ejected from the nozzles (nozzles #1 and #2 in the diagram) that are not in opposition to the print paper P lands on the recessed section 302 instead of landing on the print paper P. In this manner, by ejecting ink toward an area larger than the print paper P, a border can be kept from being formed at the top edge of the print paper P.

Figure 22:
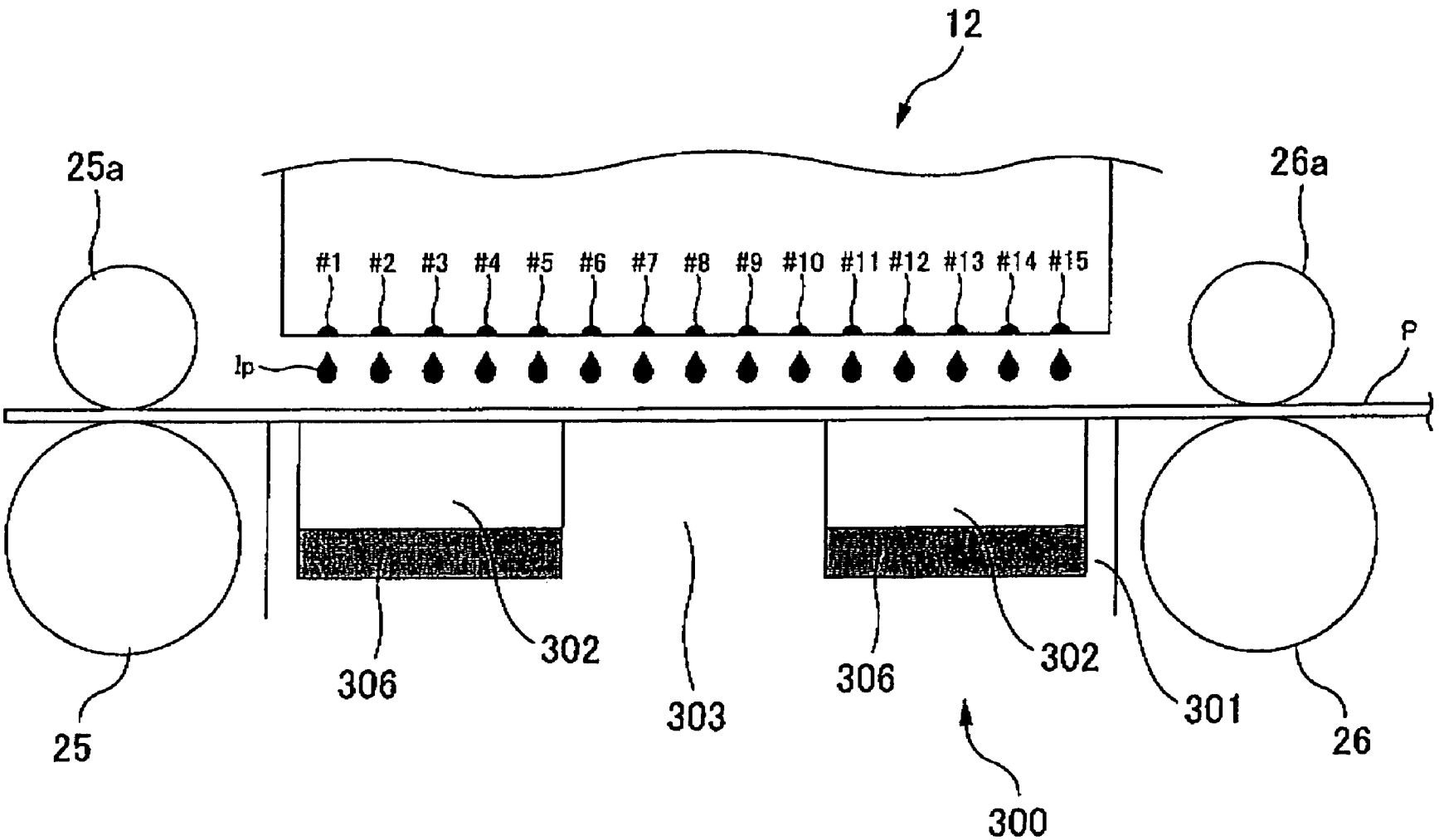
FIG. 22 is a diagram showing the manner in which the processing of normal borderless printing is performed with respect to a central portion of the print paper.

When printing at the top edge is finished, the top edge of the print paper P passes over the recessed section 302, and all of the nozzles #1 to #15 come to be in opposition to the print paper P as shown in. FIG. 22. Thus, when printing at the top edge is finished, printing of the image is performed using all of the nozzles #1 to #15. At this time, the left and right edges of the print paper P are positioned over the absorbing material 306 as shown in FIG. 16, so that all of the ink droplets Ip that have landed outside the print paper P are absorbed by the absorbing material 306, and thus the protruding sections 303 to 305 can be prevented from becoming dirty. In this manner, by ejecting ink toward an area larger than the print paper P, borders can be kept from being formed at the left and right edges of the print paper P.

Figure 23:
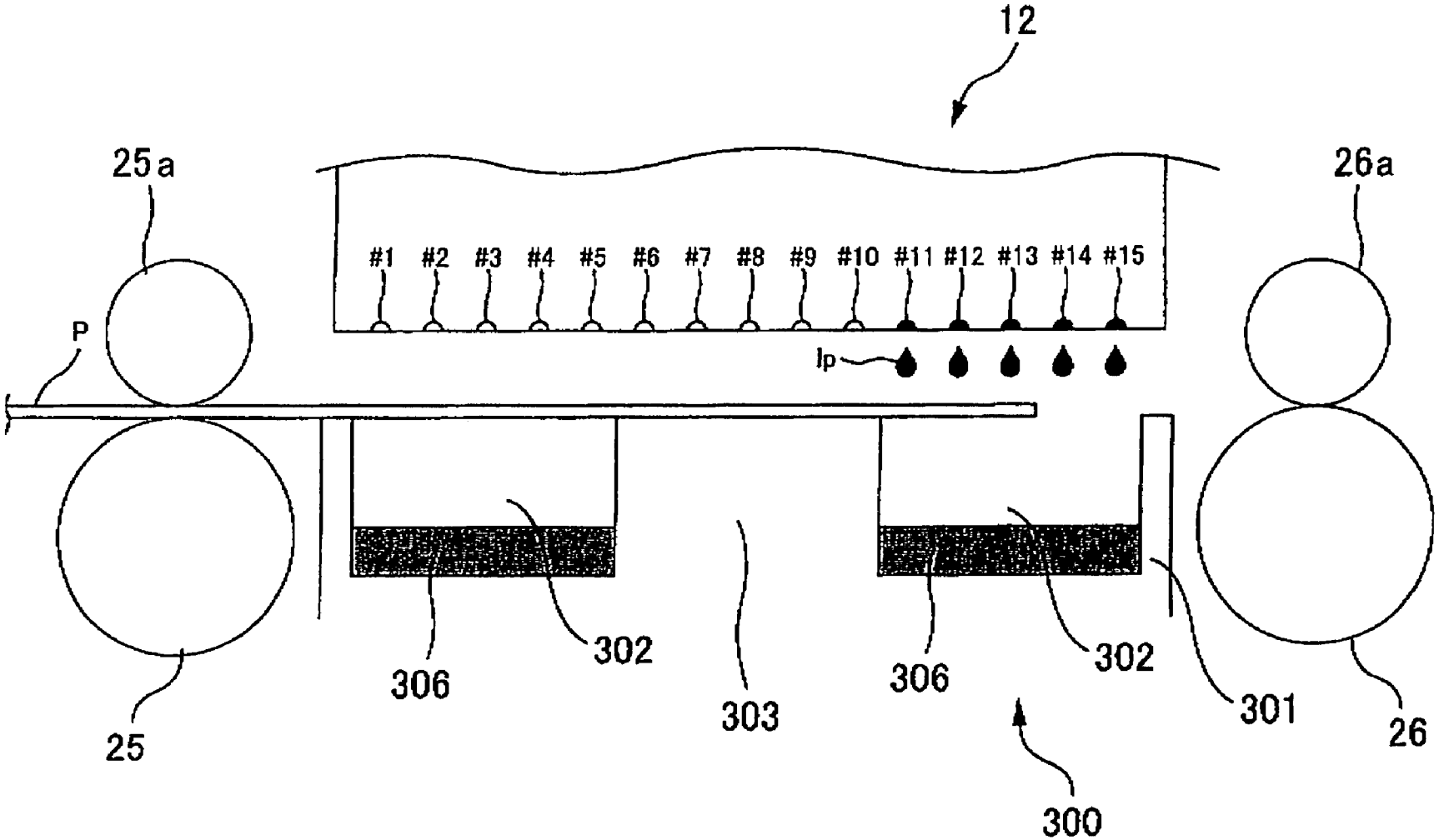
FIG. 23 is an explanatory diagram of bottom edge processing during the processing of normal borderless printing.

When the print processing using all of the nozzles is continued, the bottom edge of the print paper P passes the paper feed roller 26, and the bottom edge of the print paper P comes to be positioned under the nozzles #11 to #15 as shown in FIG. 23. Then, the print processing using all of the nozzles is finished, and subsequently, a processing (bottom edge processing) of printing the image on the bottom edge of the print paper P is performed using the nozzles #11 to #15 shown in FIG. 23. At this time, ink ejected from the nozzles (nozzles #14 and #15) that are not in opposition to the print paper P lands on the recessed section 302 instead of landing on the print paper P. In this manner, by ejecting ink toward an area larger than the print paper P, a border can be prevented from being formed at the bottom edge of the print paper P.

Through the above-described process, the processing of normal borderless printing is completed.

<Processing of Borderless Printing according to the Present Embodiment (Steps S25 and S26)>

Step S25: The application program 201 passes the image data to the printer driver program 210, and requests it to generate print data PD. The printer driver program 210 performs resolution conversion, dithering, etc. with respect to the received image data so as to generate print data PD having a size larger than the size of the print paper P by a predetermined amount, and supplies the print data PD to the printer 22.

Here, the procedure goes to print processing of step S26 in such a case where the image data is positioned on the protruding sections 303 to 305 as shown in FIG. 18 or where the margin is not sufficient as shown in FIG. 20, for example. In these cases, if printing is performed without taking any special measures, ink droplets Ip may adhere to the protruding sections 303 to 305 and make them dirty. Therefore, in the print processing of step S26, the nozzles (both or either of the nozzles #1 to #5 and the nozzles #11 to #15) other than the nozzles #6 to #10 that are positioned directly over the protruding sections 303 to 305 are used to perform printing with respect to all portions. Thus, in the processing of step S25, the print data PD is generated in accordance with the nozzles to be used. The nozzles to be used are described in the specific examples further below.

Step S26: The printer driver program 210 supplies the print data PD generated as described above to the printer 22 for printing. Thus, the printer 22 feeds the print paper P and performs printing using the nozzles (both or either of the nozzles #1 to #5 and the nozzles #11 to #15) other than the nozzles #6 to #10 that are positioned directly over the protruding sections 303 to 305 with respect to all portions. Consequently, even when a print paper P other than the standard sized papers is used, borderless printing can be performed without causing the protruding sections 303 to 305 to become dirty.

Specific Examples of the Print Processing According to the Present Embodiment

<Example of Using Only the Nozzles #1 to #5>

Figure 24:
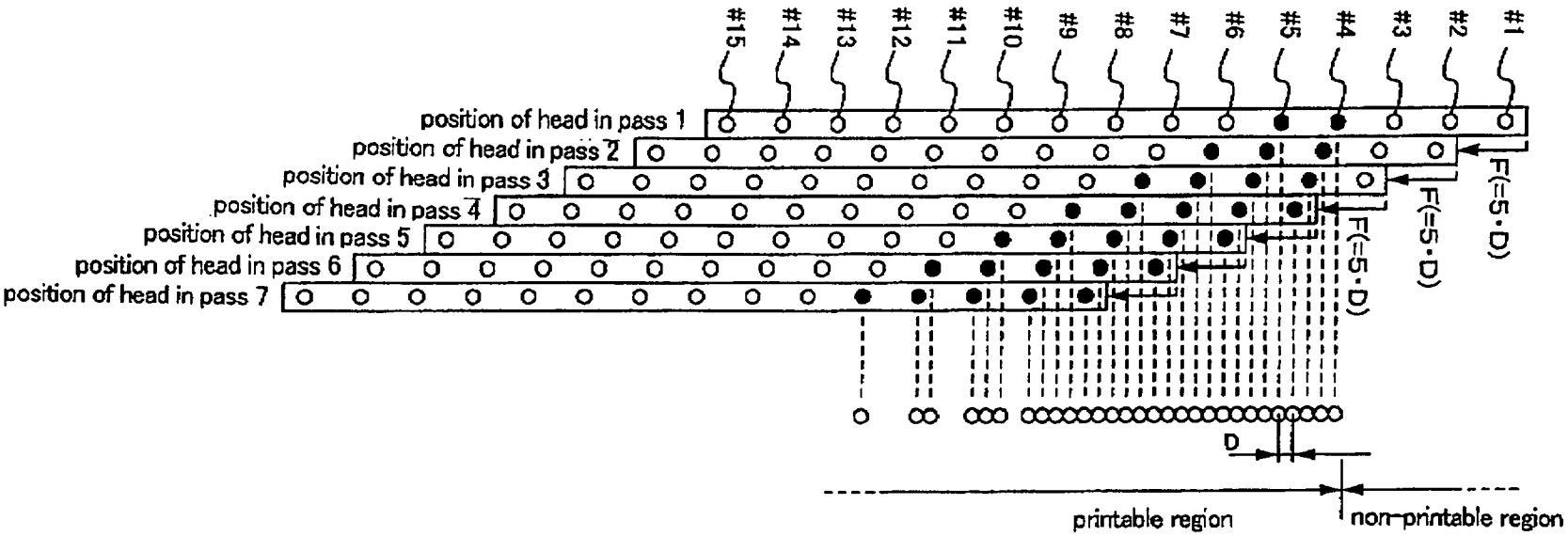
FIG. 24 is an explanatory diagram of a first specific example of this embodiment.

FIG. 24 is an explanatory diagram of a printing method in the case where only the nozzles #1 to #5 are used. Since the number N of nozzles to be used is 5 and k is 4, the condition that "N and k are coprime" is satisfied. Moreover, since 5 nozzles are used, the print paper is carried using a carry amount of 5·D.

First, a piece of print paper P is fed, and the top edge of the print paper P reaches under the nozzles #1 to #5 (similar to FIG. 21). Then, the top edge processing is performed using the nozzles #1 to #5 and the top edge portion of the image data is printed.

Figure 25:
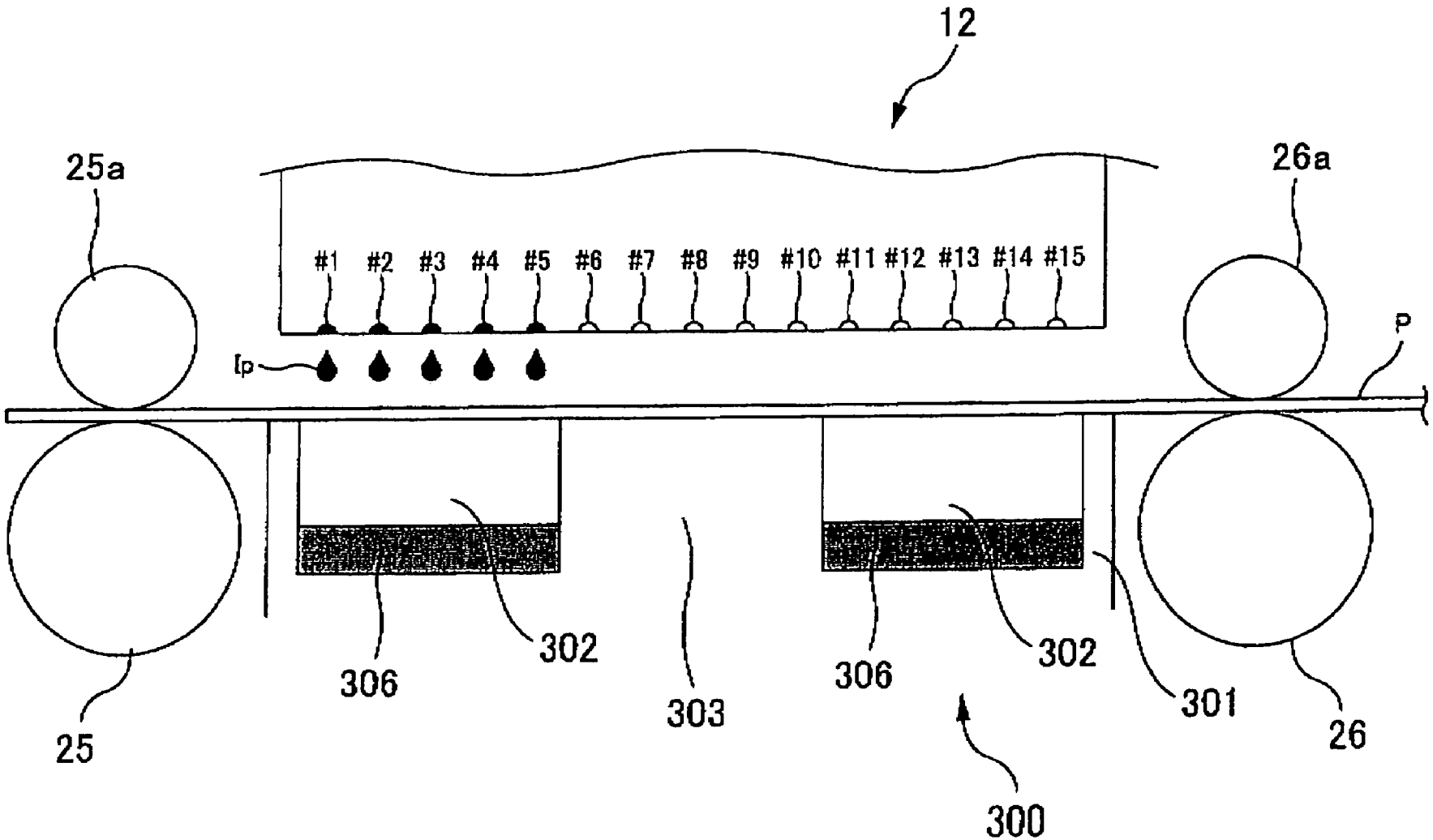
FIG. 25 is a diagram showing the manner in which processing of borderless printing is performed with respect to the central portion of the print paper.

In this example, even after the top edge of the print paper P has passed over the recessed section 302 and all of the nozzles #1 to #15 have come to be in opposition to the print paper P, printing of the image is performed using the nozzles #1 to #5 as shown in FIG. 25. At this time, even when the left and right edges of the print paper are positioned on the protruding sections 303 to 305, the left and right edges of the print paper P in the region where ink is ejected are positioned over the absorbing material 306, so that all of the ink droplets that have landed outside the print paper P are absorbed by the absorbing material 306.

Figure 26:
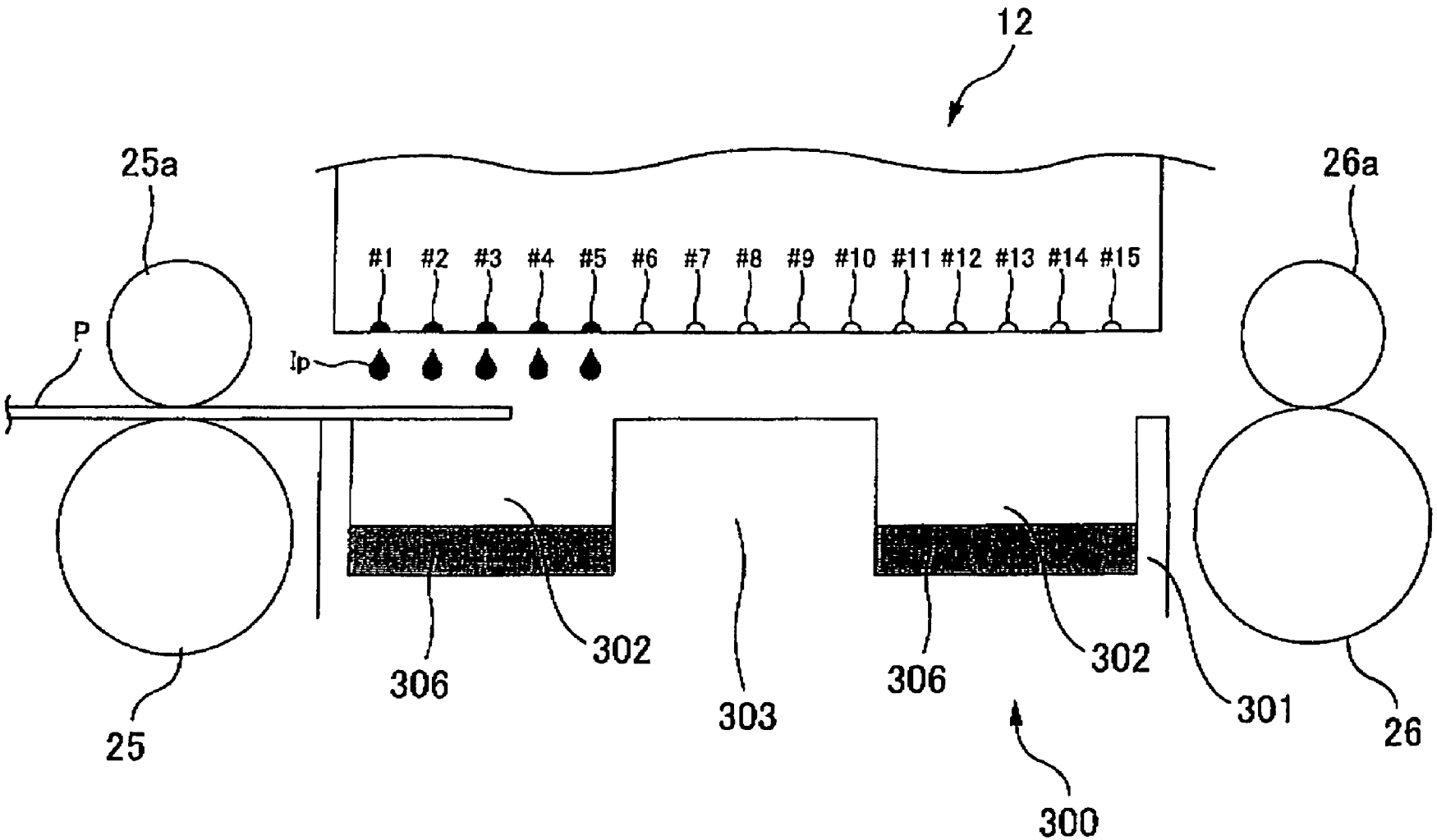
FIG. 26 is an explanatory diagram of the bottom edge processing of the first specific example.

When the print processing is continued, the bottom edge of the print paper P passes the paper feed roller 26. In the processing of normal borderless printing described above, the nozzles #11 to #15 were used to print the image on the bottom edge of the print paper P as shown in FIG. 23, but in this example, the nozzles #1 to #5 are used as shown in FIG. 26. Thus, printing can be completed using only the nozzles #1 to #5 without switching the nozzles used in the course of printing.

Figure 27:
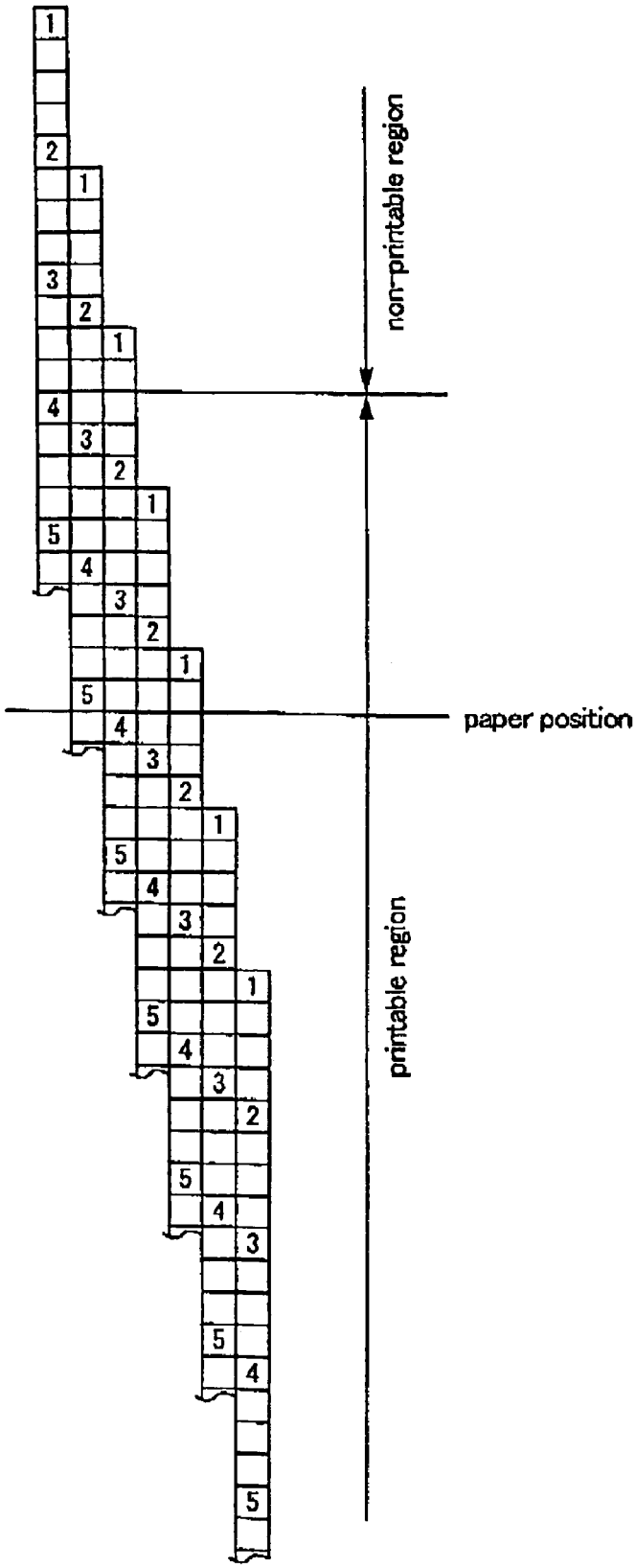
FIG. 27 is a diagram in which the first specific example is shown in another way.

For reference, the printing method in FIG. 24 also can be illustrated as shown in FIG. 27. The square grids lined up in the longitudinal direction shown in the diagram indicate the print head, and the numerals in the square grids indicate the numbers of the nozzles. In this example, the image is formed by ejecting ink while the nozzle group on the downstream side including the numerals "1", "2", "3", "4", and "5" are moved. It should be noted that in the diagram, a non-printable region indicates a region in which raster lines cannot be completely filled. Therefore, the print data PD is generated so that no raster line is formed in this region. Moreover, a printable region indicates a region in which raster lines can be completely filled. Furthermore, the paper position indicates an assumed position of the top edge of the paper in the case where borderless printing is performed. That is, in this example, image data corresponding to 10 lines above the position of the top edge of the paper lies outside the print paper P, and a region between this paper position and the non-printable region is the outside portion of the top edge.

<Example of Using Only the Nozzles #11 to #15>

Figure 28:
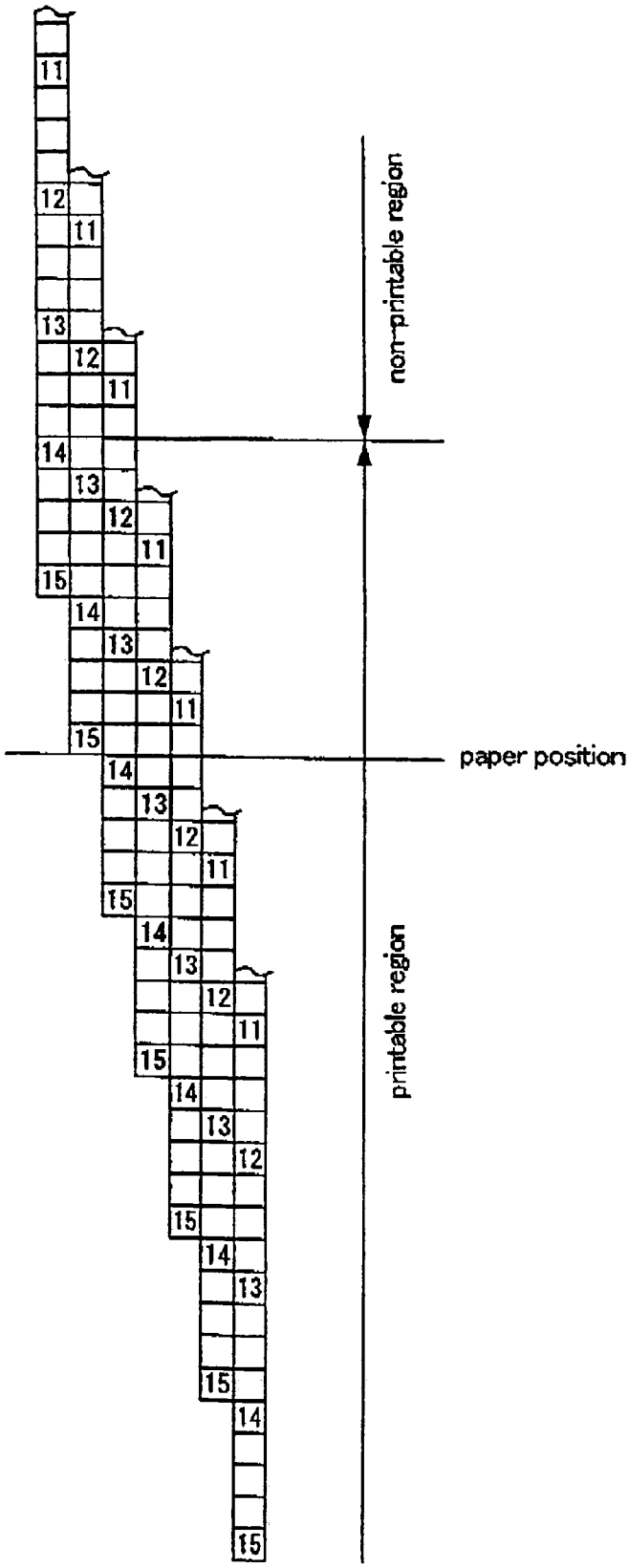
FIG. 28 is an explanatory diagram of a second specific example of this embodiment.

FIG. 28 is an explanatory diagram of a printing method in the case where only the nozzles #11 to #15 are used. Since the number N of nozzles to be used is 5 and k is 4, the condition that "N and k are coprime" is satisfied. Moreover, since 5 nozzles are used, the print paper is carried using a carry amount of 5·D.

In this example, when the print paper P is fed, the top edge of the print paper P reaches under the nozzles #11 to #15. Then, the top edge processing is performed using the nozzles #11 to #15, and the top edge portion of the image data is printed. In this example, even after the top edge of the print paper P has passed over the recessed section 302 and all of the nozzles #1 to #15 have come to be in opposition to the print paper P, printing of the image is performed using the nozzles #11 to #15. Then, after the bottom edge of the print paper P passes the paper feed roller, the bottom edge processing is performed using the nozzles #11 to #15.

Also in this example, all of the ink droplets that have landed outside the print paper P are absorbed by the absorbing material 306 as in the case of the above-described example, so that the protruding sections 303 to 305 can be prevented from becoming dirty.

<Example of Using the Nozzles #1 to #5 and the Nozzles #11 to #15>

Figure 29:
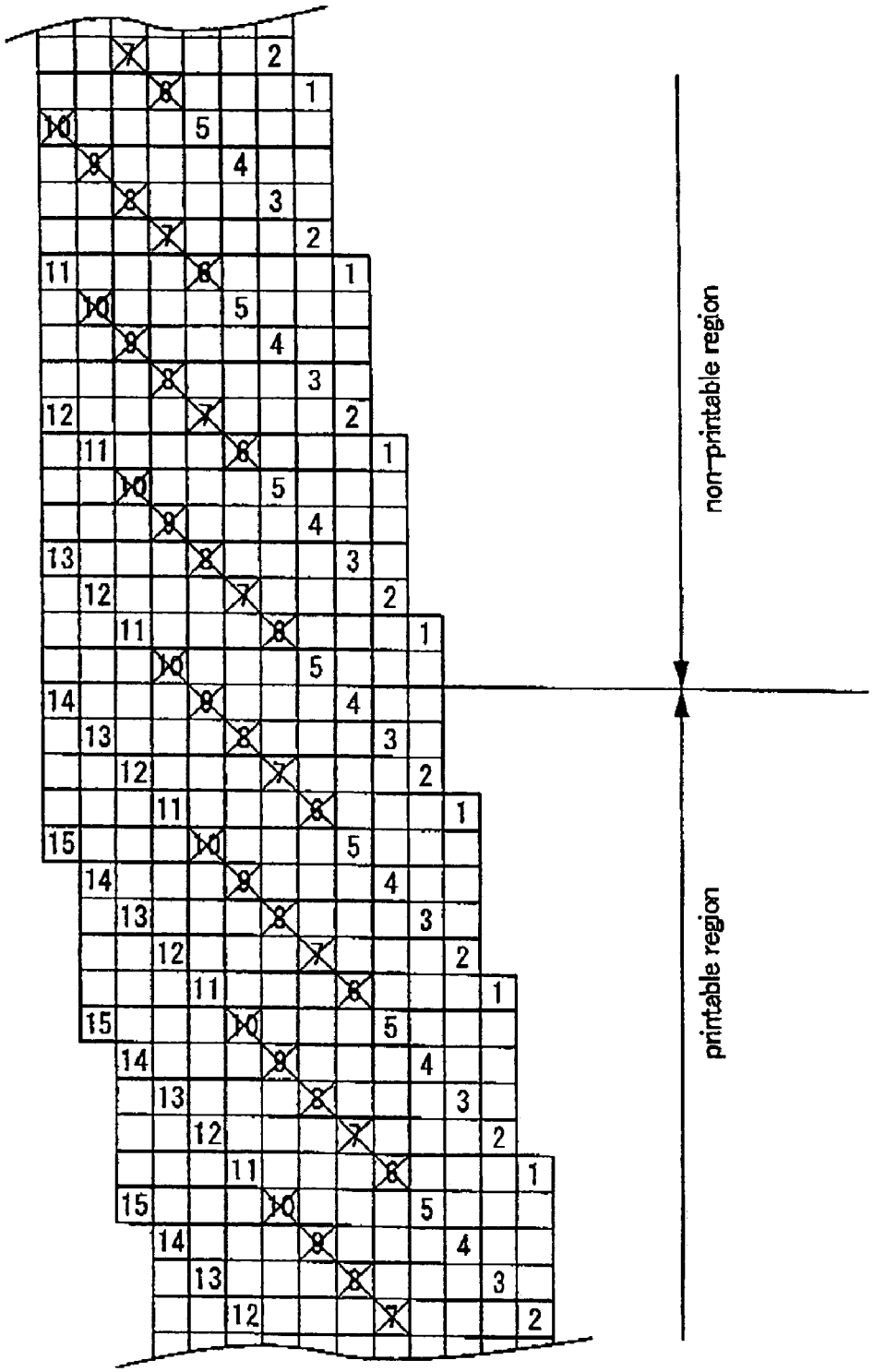
FIG. 29 is an explanatory diagram of a third specific example of this embodiment.

FIG. 29 is an explanatory diagram of a printing method in the case where the nozzles #1 to #5 and the nozzles #11 to #15 are used. In this embodiment, the nozzles #6 to #10 in opposition to the protruding sections 303 to 305 do not eject ink. Thus, the square grids in the diagram corresponding to the nozzles #6 to #10 are marked with a cross. That is, in the diagram, the square grids marked with a cross indicate the numbers of the nozzles that do not eject ink.

In the above-described printing methods, one raster line is formed with one nozzle, but in this example, one raster line is formed with two nozzles. For example, even-numbered pixels of a certain raster line are formed by the nozzle #14, and odd-numbered pixels of that raster line are formed by the nozzle #4. Also, odd-numbered pixels of a certain raster line are formed by the nozzle #13, and even-numbered pixels of that raster line are formed by the nozzle #3.

When a raster line is formed with M nozzles, the conditions for performing recording while keeping the carry amount constant are: N/M is an integer; N/M and k are coprime; and the carry amount is set to (N/M)·D. In this example, the number N of nozzles to be used is 10, so that the condition that "N/M is an integer" is satisfied. Also, the number N of nozzles to be used is 10, the number M of nozzles for forming one raster line is 2, and k is 4, so that the condition that "N/M and k are coprime" is satisfied. The carry amount is set to 5·D(=(10/2)·D).

<Example of Carrying in the Reverse Direction During Printing>

Figure 30:
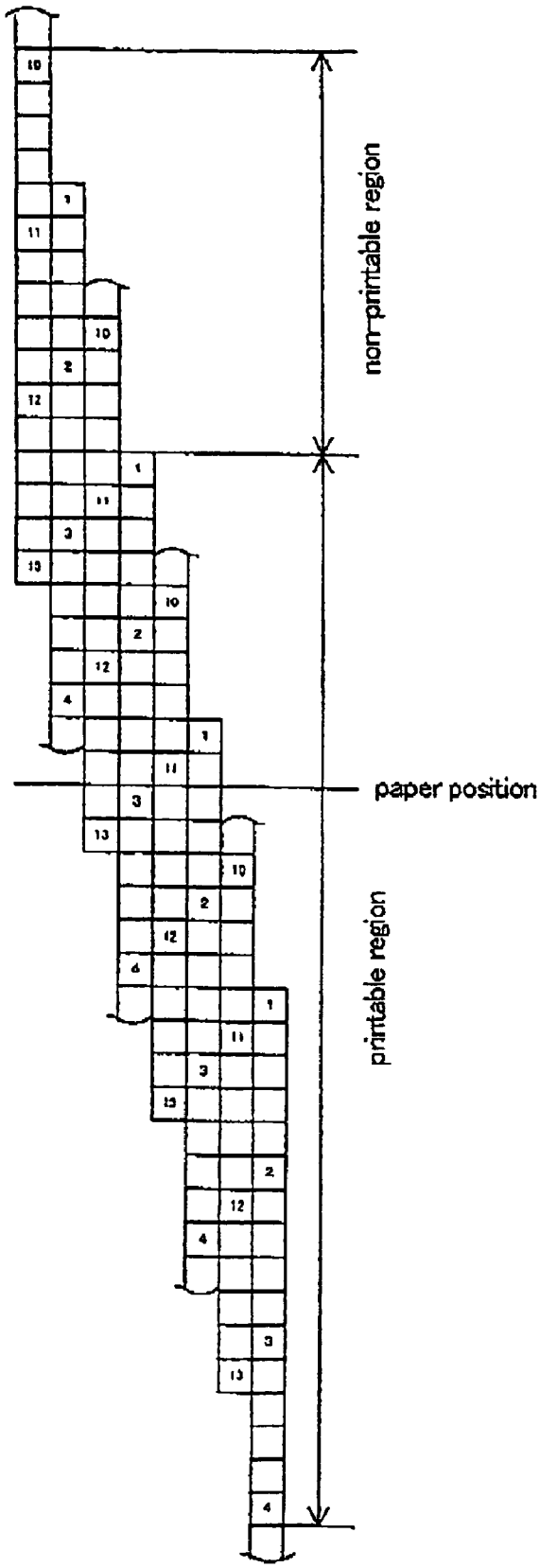
FIG. 30 is a diagram showing another example of the print processing.

FIG. 30 is an explanatory diagram of a printing method in the case of carrying in the reverse direction during printing. Here, for convenience of description, the total number of nozzles is 13, and the nozzles in the position that is opposed to the recessed section are the nozzles #1 to #4 and the nozzles #10 to #13. Moreover, although k, which indicates the nozzle pitch, was 4 in the above-described examples, here, k is 5 for convenience of description.

Here, raster lines that are continuous in the carrying direction are printed one by one with the nozzles #1 to #4 and the nozzles #10 to #13 alternately.

Figure 31:
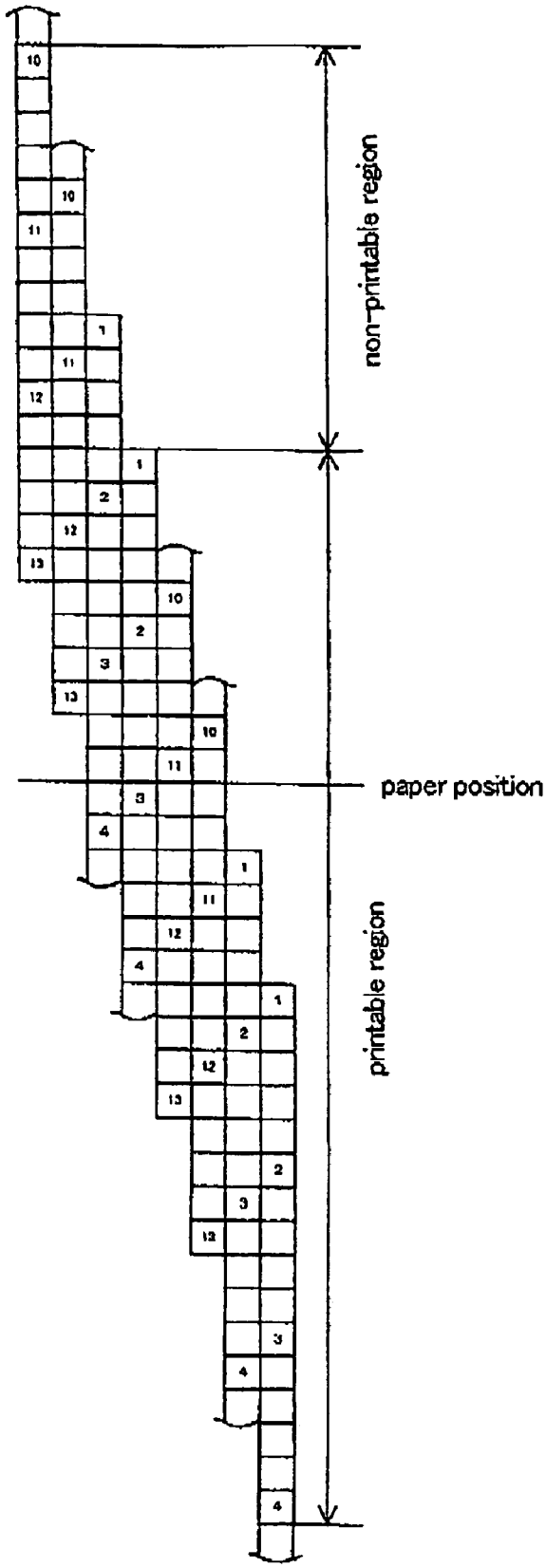
FIG. 31 is a diagram showing another example of the print processing.

Moreover, as shown in FIG. 31, raster lines that are continuous in the carrying direction can be printed two at a time with the nozzles #10 to #13 and the nozzles #1 to #4 alternately. Furthermore, raster lines also can be printed in groups of three or more alternately.

It should be noted that in FIGS. 30 and 31, for the sake of simplifying the description, only one nozzle row of a plurality of nozzle rows that are present is used for description. Moreover, it is assumed that one nozzle row has 13 nozzles. Furthermore, it is assumed that the nozzles are arranged at a spacing corresponding to four raster lines.

Moreover, in FIGS. 30 and 31, the print head 12, which is transported relatively in the carrying direction with time, is shown displaced in order from left to right. As shown in FIGS.

30 and 31, transportation is performed by a constant amount of 4 dots or 8 dots. Consequently, in each raster line, dots of are recorded by one nozzle. It should be noted that "dot", which is a unit of carry amount (sub-scan feed amount), means a pitch of a single dot corresponding to the print resolution in the carrying direction, and this is equal to the pitch of the raster lines. The nozzles provided with numerals in FIGS. 30 and 31 are the nozzles for recording dots on the raster lines.

In the printer 22, a piece of print paper P is first supplied (picked up), paper feed is performed, and the front end of the print paper P reaches under the nozzles #1 to #4. Next, the top edge processing is performed using the nozzles #1 to #4, and the top edge portion of the image data is printed.

When the top edge processing has been finished, print processing is performed using both of the nozzles #1 to #4 and the nozzles #10 to #13. At this time, the nozzles #5 to #9 are not used, so that ink does not adhere to the protruding sections 303 to 305 and make them dirty.

Then, when the rear end of the print paper P reaches under the nozzles #10 to #13, the bottom edge processing is performed, and then paper discharge processing is performed.

As described above, according to this embodiment, when borderless printing is performed, the length of the print paper P in the left to right direction is detected, and then, when the ink absorbing material 306 is present in an area where printing is performed outside the print paper P in the movement direction and when there is a sufficient margin, printing is performed using all of the nozzles, and otherwise printing is performed using only the nozzles corresponding to the section where the ink absorbing material 306 is present. Consequently, even when a print paper P other than the standard sized papers is used, borderless printing can be performed without causing the protruding sections 303 to 305 to become dirty.

Other Embodiments

In the foregoing, one embodiment of the present invention was described, but it is possible to perform various alternations to the present invention in addition to this embodiment.

<Regarding the Ink>

For example, the four colors of ink in CMYK were used in the above-described embodiment. However, it is also possible to use light-colored (light cyan (LC), light magenta (LM), and dark yellow (DY)) inks in addition to these four colors.

<Regarding the Print Read>

Moreover, in the above-described embodiment, the printer 22 provided with the head for ejecting ink using piezo elements was used. However, it is also possible to adopt various ejection driving elements other than the piezo elements For example, the present invention also can be adopted for a printer provided with ejection driving elements of a type in which ink is ejected by passing a current through a heater disposed in an ink channel so as to generate bubbles within the ink channel.

<Regarding Paper Feed>

Moreover, in the above-described embodiment, a case where the print paper P stored in a paper stacker is fed automatically to perform printing was described as an example. However, it is also possible to perform the same processing, for example, in the case where the print paper P is supplied manually. Furthermore, the determination of whether or not the margin is sufficient in step S22 may be omitted, and further, when the position of the right edge of the print paper P can be changed, a step of determining whether or not the right edge is over the absorbing material may be added.

<Regarding the Length of the Print Paper>

Moreover, in the above-described embodiment, the length of the print paper P in the left to right direction was detected using the optical sensor 39. However, the length may be input to the computer 90 by a user directly. Moreover, when a standard sized paper other than the above-described standard sized papers (Japanese L size, postcard, B5, and A4) is used, information about its size may be obtained from a table by inputting the name of that standard sized paper.

Furthermore, in the above-described embodiment, the size of the print paper P was detected using the optical sensor 39 provided on the print head 12. However, it is also possible to use a line sensor, for example, to detect the size. Moreover, in the case of a printer having a scanner, it is also possible to measure the size of the print paper P with the scanner before performing printing.

<Regarding the Platen 1>

Moreover, in the above-described embodiment, the platen 300 was described taking the rectangular frame 301 having the protruding sections 303 to 305 as shown in FIG. 5 as an example. However, the present invention is not limited to this and can be applied to a platen having other shapes as well. Moreover, regarding the surface shape of the print medium, the present invention can be applied to various shapes, such as a circle, a triangle, a pentagon, and a trapezoid, in addition to the quadrangle as in the above-described embodiment with such a non-quadrangular shape, the shape is detected instead of the dimensions and print data is created in accordance with that shape, but the term "size" is intended to include this shape.

Figure 32A:
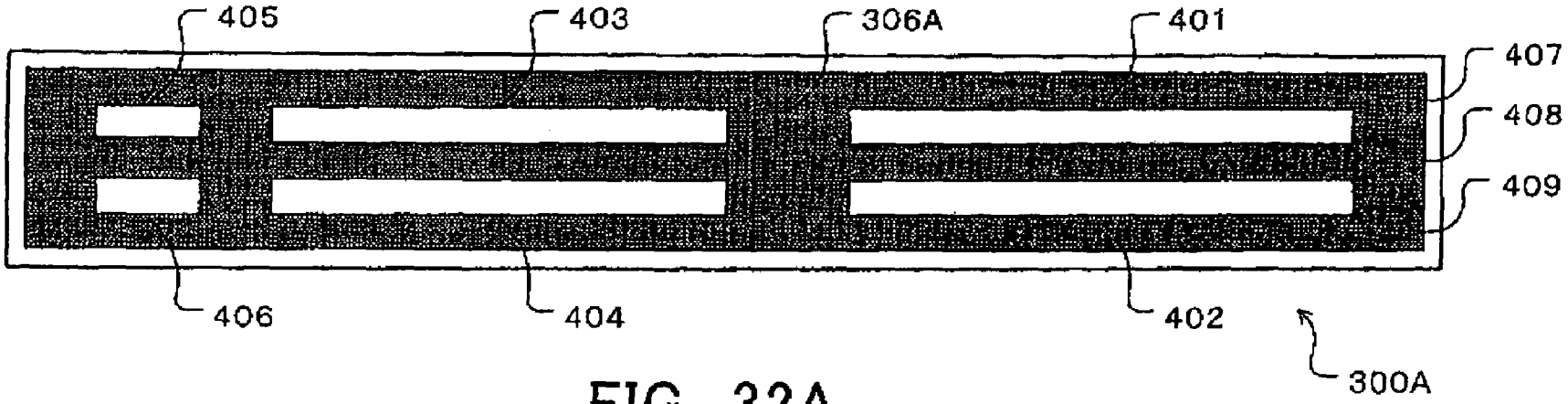
FIG. 32A is a diagram showing a configuration example of a platen having six protruding sections.

For example, in a platen 300A shown in FIG. 32A, six protruding sections 401 to 406 are provided. In the case of such a platen 300A, printing can be performed using three regions 407 to 409 of an absorbing material 306A that are continuous from left to right, so that borderless printing can be performed at a higher speed than in the case of the platen 300 shown in FIG. 5.

Figure 32B:
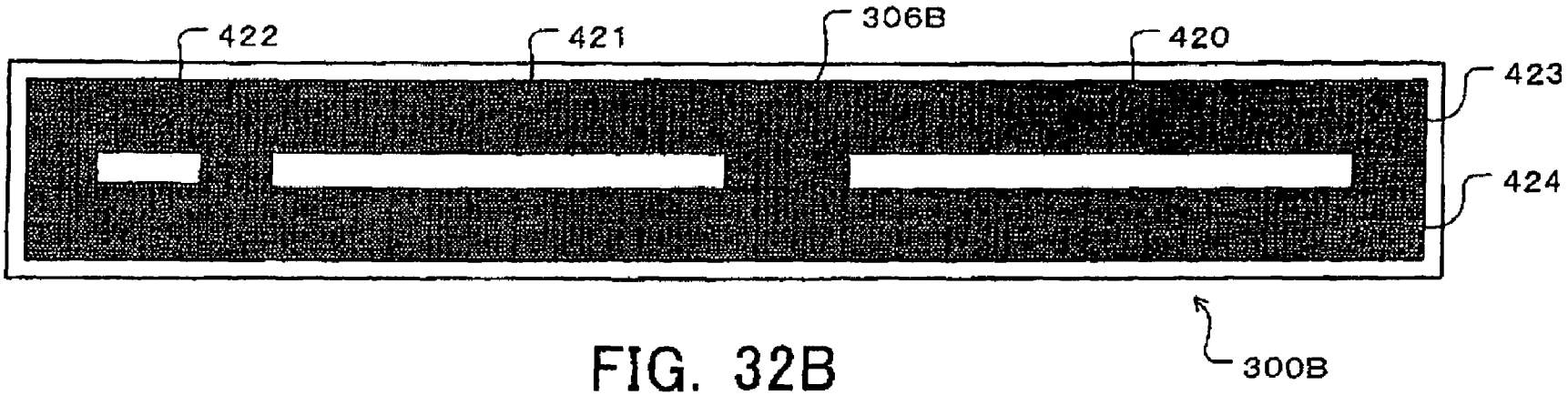
FIG. 32B is a diagram showing a configuration example of a platen having a narrow protruding section.

Moreover, a platen 300B shown in FIG. 32B has three narrow protruding sections 420 to 422. In the case of such a platen 300B, printing can be performed using broad regions 423 and 424 of an absorbing material 306B that are continuous from left to right, so that borderless printing can be performed at a higher speed than in the case of the platen 300 shown in FIG. 5.

<Regarding the Platen 2>

In the above-described embodiment, two recessed sections 306 extending along the movement direction of the carriage were provided on the upstream side and the downstream side of the protruding sections 303 to 305 in the carrying direction (for example, see FIG. 4). However, it is also possible to provide a single recessed section extending along the movement direction of the carriage.

Figure 33:
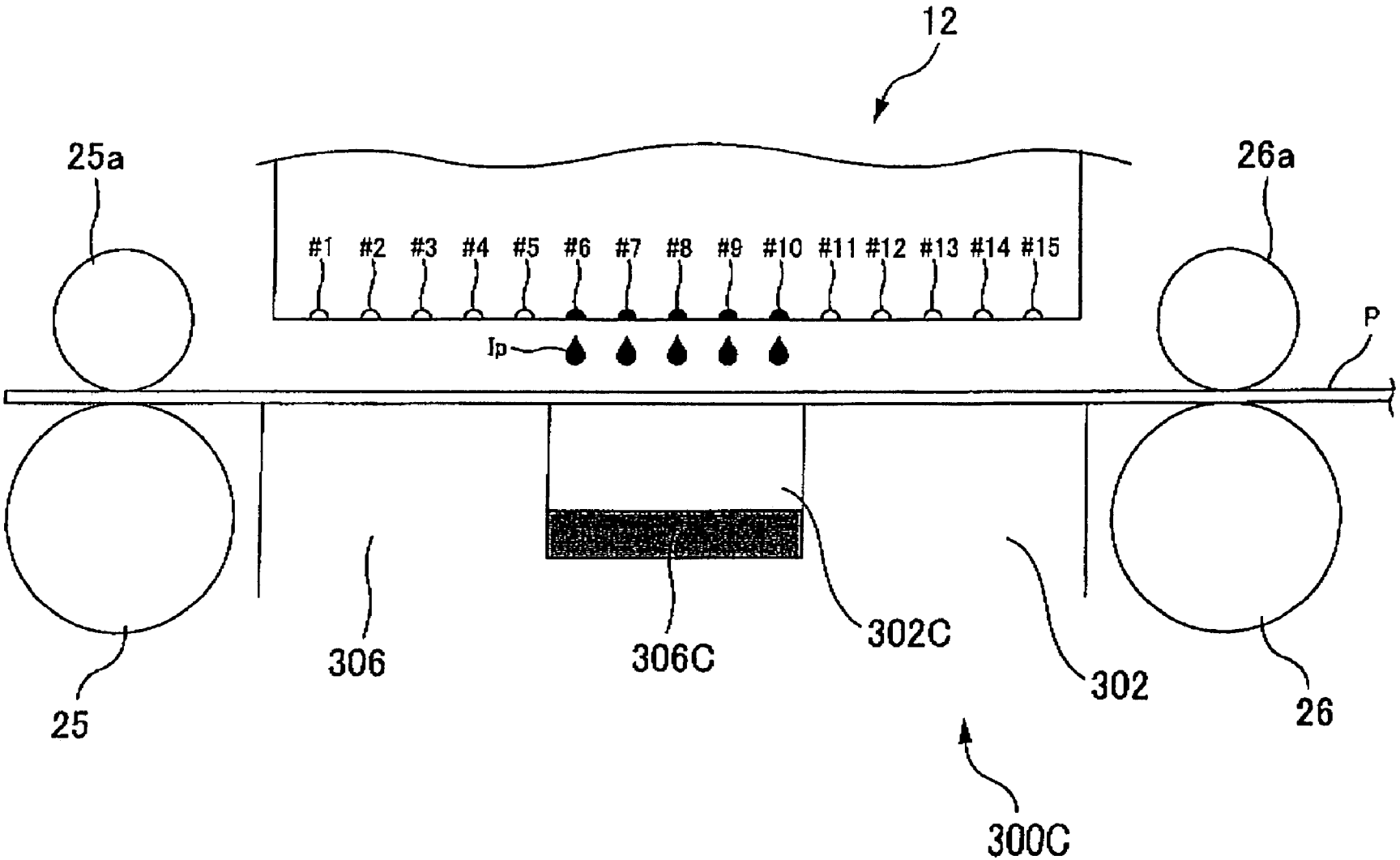
FIG. 33 is a diagram showing the manner in which the print processing is performed when there is a single recessed section.
Figure 34:
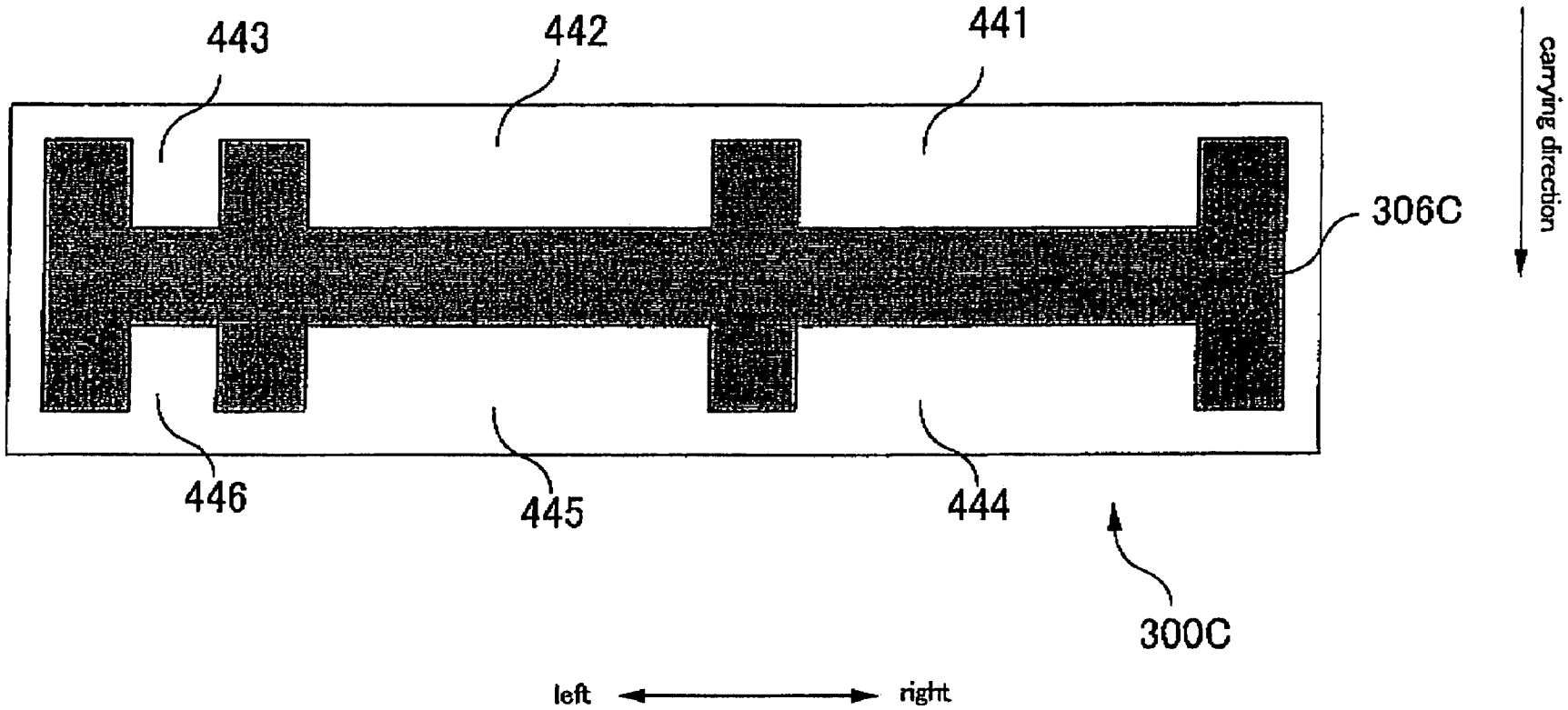
FIG. 34 is a diagram showing a configuration example of the platen.

FIG. 33 is an explanatory diagram of an example in which there is a single recessed section extending along the movement direction of the carriage. FIG. 34 is a diagram showing a configuration example of a platen of this embodiment.

A platen 300C is provided with six protruding sections 441 to 446. An absorbing material 306C is positioned between the protruding sections 441 to 443 on the upstream side in the carrying direction and the protruding Sections 444 to 446 on the downstream side in the carrying direction.

#11 to #15 of the nozzle row for each color are provided in a position that is opposed to the protruding sections 441 to 443 on the upstream side. #1 to #5 of the nozzle row for each color are provided in a position that is opposed to the protruding sections 444 to 446 on the downstream side. #6 to #10 of the nozzle row for each color are provided in a position that is opposed to a portion of the recessed section 306C that is continuous in the movement direction of the carriage.

In the case of normal borderless printing, the printer 22 first feeds the print paper P until the top edge of the print paper P comes to be under the nozzles #6 to #10. Then, ink is ejected from the nozzles #6 to 10 to perform the processing (top edge processing) of printing an image on the top edge of the print paper P. Then, when all of the nozzles come to be in opposition to the print paper P, printing of the image is performed using all of the nozzles #1 to #15. When the bottom edge of the print paper P passes the paper feed roller, the bottom edge of the print paper P comes to be positioned under the nozzles #11 to #15. At this time, if ink is ejected from the nozzles #11 to #15, ink may land on the protruding sections 441 to 443 on the upstream side. Thus, the nozzles #11 to #15 are inhibited from ejecting ink, and the bottom edge processing is performed using the nozzles #6 to #10.

In the case where the left edge of the print paper P is positioned on the protruding sections 441 to 446 or where the margin m is not sufficient, borderless printing is performed in the following manner. First, the printer 22 feeds the print paper P until the top edge of the print paper P comes to be under the nozzles #6 to #10. Then, the top edge processing is performed using the nozzles #6 to 10. Even after all of the nozzles #1 to #15 come to be in opposition to the print paper P, printing of the image is performed using the nozzles #6 to #10 as shown in FIG. 33. Then, the bottom edge processing is performed using the nozzles #6 to #10. Thus, printing can be completed using only the nozzles #6 to 10.

<Regarding the Program>

The program in which the above-described processing function is written can be stored on a computer-readable storage medium. Examples of the computer-readable storage medium include magnetic storage devices, optical disks, magneto optic storage media, and semiconductor memories. Examples of the magnetic storage devices include hard disk drives (HDD), flexible disks (FD), and magnetic tapes. Examples of the optical disks include DVDs, DVD-RAMs (Random Access Memory), CD-ROMS, and CD-R(Recordable)/RW(ReWritable) disks. Examples of the magneto optic storage media include MOs.

To distribute the program, for example, transportable storage media, such as DVDs or CD-ROMs, storing that program are sold commercially. Moreover, it is also possible to store the program in a storage device of a server computer and transfer that program from the server computer to other computers over a network.

A computer for executing the program stores, for example, the program, which is stored on the transportable storage medium or which has been transferred from the server computer, in its own storage device. Then, the computer reads out the program from its own storage device and executes the processing dictated by the program. It should be noted that it is also possible for the computer to directly read out the program from the transportable storage medium and execute the processing dictated by that program. Moreover, it is also possible for the computer to consecutively execute the processings dictated by the received program each time the program is transferred from the server computer.

The printer driver, which is a program has codes for making the printing apparatus perform the above-described printing methods.

Overview (1) In the normal printing method, the printer first feeds a print paper (an example of the print media), and then the printer moves 15 nozzles, whose positions are different from one another in the carrying direction (direction that intersects the movement direction), and prints a print image on the print paper by ejecting ink from the moving nozzles toward the print paper supported by the protruding section.

When the printer performs borderless printing, the printer ejects ink toward the edges of the print paper. Thus, it is possible to perform printing without forming borders at the edge portions of the print paper. However, when the printer performs borderless printing, ink is ejected toward an area larger than the print paper, so that ink that does not land on the print paper is produced. The ink that has thus landed outside the print paper may make the inside of the printer and the rear surface of the print paper dirty.

Thus, the printer for performing borderless printing is provided with a protruding section. The protruding section is provided in a predetermined position so that when it supports a standard sized paper, it is positioned under the print paper (see FIG. 17). Then, when a standard sized paper is subjected to borderless printing, even when ink is ejected toward the left and right edges of the print paper from the nozzles #6 to #10 that are in opposition to the protruding section, ink that is ejected beyond the print paper is kept from landing on the protruding section (see FIG. 16).

However, when borderless printing is performed with respect to a print paper other than the standard sized papers, the left and right edges of the print paper may be positioned on the protruding section. In such a case, if ink is ejected from the nozzles #6 to #10 that are in opposition to the protruding section toward the left and right side edges of the print paper, then ink will land on the protruding section. As a result, the inside of the printer and the rear surface of the print paper may become dirty.

In order to avoid this, in the above-described printing methods, when the left and right edges (edge in the predetermined direction) of the print paper are on the protruding section, ink is not ejected from the nozzles #6 to #10 that are in opposition to the protruding section, and ink is ejected from the nozzles #1 to #5 or the nozzles #11 to #15 that are not in opposition to the protruding section toward the left and right edges of the print paper.

In this way, even if ink that does not land on the print paper is produced, the ink will not land on the protruding section. As a result, the inside of the printer and the rear surface of the print paper can be prevented from becoming dirty.

(2) In the above-described printing methods, the printer driver determines whether or not the left and right edges of the print paper are on the protruding section in accordance with the width (length in the predetermined direction) of the print paper. For example, in the platen shown in FIG. 17, when the width W of the print paper is $d1<W<d2$, it can be determined that the left edge of the print paper is not on the protruding section. Also, when the width of the print paper is $d2<W<d3$, it can be determined that the left edge of the print paper is on the protruding section.

It should be noted that the printer stores, in advance, the placement information about the position where the protruding section is provided, and the printer driver determines whether or not the left and right edges of the print paper are on the protruding section based on the width of the print paper and the placement information.

(3) In the above-described printing methods, the width (length in the predetermined direction) of the print paper is detected by moving the carriage and detecting the left and right edges (edge in the predetermined direction) of the print paper using the optical sensor, as shown in FIG. 14. Thus, the printer driver can determine whether or not the left edge of the print paper is on the protruding section based on the detected width of the print paper.

(4) However, the information about the width of the print paper may be obtained without using the optical sensor. Examples of the method for obtaining the information about the width of the print paper include a method of inputting directly by a user and a method of obtaining the information about the width from a table in accordance with the type of the paper.

(5) In the above-described printing methods, ink that does not land on the print paper is absorbed by the absorbing material. Thus, ink is not accumulated in the recessed section, so that the rear surface of the print paper can be prevented from becoming dirty.

(6) In the above-described printing methods, when the left and right edges (edge in the predetermined direction) of the print paper are not on the protruding section, ink is ejected from all of the nozzles #1 to #15 toward the left and eight edges of the print paper (see FIG. 22). When only the nozzles #1 to 5 are used, the carry amount is 5·D, but when all of the nozzles #1 to #15 are used,the carry amount is 15·D. Therefore, when the nozzles #6 to #10 that are in opposition to the protruding section can be used, the carry amount is increased, and thus the print speed can be improved.

(7) However, even when the left and right edges (edge in the predetermined direction) are not on the protruding section, when the distance m between the image data G (a region to which ink is ejected) and the protruding section 305 that is not supporting the medium is equal to or shorter than a predetermined distance as shown in FIG. 19, ink is not ejected from the nozzles #6 to #10 that are in opposition to the protruding section. The reason for this is that when the distance m is equal to or shorter than a predetermined distance, ink may adhere to the protruding section due to the effect of the deviation of ink from its flight path, for example.

(8) In the above-described printing methods, the nozzles #6 to #10 that are in opposition to the protruding section are sandwiched between the nozzles #1 to #5 that are not in opposition to the protruding section and the nozzles #11 to #15 that are not in opposition to the protruding section. This is because the protruding section provided in the platen is sandwiched between the recessed sections on the upstream side and the downstream side in the carrying direction, as shown in FIG. 4.

(9) In the above-described printing methods, in the case of normal borderless printing (when the edge of the medium in the predetermined direction is not on the protruding section), ink is ejected from the nozzles #1 to #5 toward the top edge of the print paper, and ink is ejected from the nozzles #11 to #15 toward the bottom edge of the print paper. That is, in the case of normal borderless printing, nozzles used for the top edge processing are different from those used for the bottom edge processing.

On the other hand, in the case where the left and right edges of the print paper (edge of the medium in the predetermined direction) are on the protruding section, ink is ejected from the nozzles #1 to 5 toward the top edge of the print paper, and ink is ejected from the nozzles #1 to 5 toward the bottom edge of the print paper (see FIG. 26). That is, in this case, nozzles used for the top edge processing are the same as those used for the bottom edge processing. Thus, there is no need to switch the nozzles used in the course of printing, so that printing can be completed using only the nozzles #1 to #5, and printing can be completed using a constant carry amount, and thus the Image quality of the print image is improved.

(10) In the above-described printing methods, when the number of nozzles for ejecting ink is N, the dot spacing is D, and the nozzle pitch is k×D, then N and k are coprime, and the carry amount is set to N×D. Thus, it is possible to obtain the print image at a resolution higher than the nozzle pitch while carrying the print paper using a constant carry amount. For example, a print image at a resolution of 720 dpi can be obtained using a print head with a nozzle pitch of 180 dpi.

(11) In the printing methods shown in FIGS. 27 and 28, printing is performed using only either of the nozzles #1 to #5 or the nozzles #11 to #15. However, it is also possible to use both of the nozzle groups to perform printing.

(12) For example, in the printing method shown in FIG. 29, printing is performed using both of the nozzle groups, that is, the nozzles #1 to #5 and the nozzles #11 to #15. In such a printing method using two nozzle groups, it is desirable that N/2 and k are coprime and the carry amount is set to (N/2)×D. Thus, it is possible to perform printing so that one raster line is formed with two nozzles. Thus, the effect that the manufacturing variation of the nozzle has on the raster lines is alleviated, so that the image quality of the print image is improved.

(13) Moreover, in the printing methods shown in FIGS. 30 and 31, printing is performed using both of the nozzle groups by repeating carrying in the carrying direction and carrying in the reverse direction and using the nozzles #1 to #5 and the nozzles #11 to #15 alternately.

(14) In the printing method shown in FIG. 33, the nozzles #6 to #10 that are not in opposition to the protruding section are sandwiched between the nozzles #1 to #5 that are in opposition to the protruding section and the nozzles #11 to #15 that are in opposition to the protruding section. This is because the recessed section provided in the platen is sandwiched between the protruding sections on the upstream side and the downstream side in the carrying direction, as shown in FIG. 34.

(15) An embodiment including all of the configurations of the above-described printing methods is preferable as it can achieve all of the effects.

(16) The above-described printing apparatus refers to a combination of the printer and the computer. The printer driver is installed on the computer. The printer is provided with the protruding section and the carriage motor. The protruding section is provided in a predetermined position so that when it supports a standard sized paper, it is positioned under the print paper. The carriage motor moves the carriage, thereby moving 15 nozzles in the movement direction of the carriage (a predetermined direction).

When such a printer performs borderless printing with respect to a print paper other than the standard sized papers, the left and right edges of the print paper may be positioned on the protruding section. In such a case, if ink is ejected from the nozzles #6 to #10 that are in opposition to the protruding section toward the left and right edges of the print paper, ink lands on the protruding section. As a result, the inside of the printer and the rear surface of the print paper may become dirty.

In order to avoid this, in the above-described printing apparatus, when the left and right edges (edge in the predetermined direction) of the print paper are on the protruding section, the control circuit (an example of a controller) of the printer keeps the nozzles #6 to #10 that are in opposition to the protruding section from ejecting ink and makes the nozzles #1 to #5 and/or the nozzles #11 to #15 that are not in opposition to the protruding section eject ink toward the left and right edges of the print paper. It should be noted that such an operation is achieved through generation of print data by the CPU (an example of a controller) of the computer on which the printer driver is installed and control of the components in the printer by the control circuit of the printer based on the print data. That is, such an operation is achieved by the control circuit of the printer and the CPU of the computer, which serve as the controller of the printing apparatus.

With such a printing apparatus, the inside of the printer and the rear surface of the print paper can be prevented from becoming dirty.

(17) The above-described printer driver (an example of a program) makes the computer generate the print data and send the print data to the printer. Based on the print data, the printer operates in such a manner that when the left and right edges (edge in the predetermined direction) of the print paper are on the protruding section, the control circuit (an example of the controller) of the printer keeps the nozzles #6 to #10 that are in opposition to the protruding section from ejecting ink and makes the nozzles #1 to #5 and/or the nozzles #11 to #15 that are not in opposition to the protruding section eject ink toward the left and right edges of the print paper. That is, the printer driver is provided with codes for making the printing apparatus perform such an operation.

With such a program, it is possible to control the printing apparatus so that the inside of the printer and the rear surface of the print paper can be prevented from becoming dirty.

What is claimed is:

1. A printing method for printing a print image on a medium, comprising the following steps of:

supporting said medium with a protruding section provided in a predetermined position in a predetermined direction;

moving a plurality of nozzles whose positions are different from one another in a direction that intersects said predetermined direction, wherein said plurality of nozzles comprises nozzles that are in opposition to said protruding section and nozzles that are not in opposition to said protruding section while they are moved in said predetermined direction; and printing the print image on said medium by ejecting ink from the plurality of moving nozzles toward said medium supported by said protruding section, wherein when an edge of said medium in said predetermined direction is on said protruding section, said ink is not ejected from the nozzles that are in opposition to said protruding section and said ink is ejected from the nozzles that are not in opposition to said protruding section toward the edge of said medium in said predetermined direction, wherein the nozzles that are in opposition to said protruding section are sandwiched between two groups of nozzles that are not in opposition to said protruding section.

2. A printing method according to claim 1 wherein when the edge of said medium in the predetermined direction is not on said protruding section, said ink is ejected from one of said two groups of nozzles that are not in opposition to said protruding section toward a top edge of said medium, and said ink is ejected from the other of said two groups of nozzles that are not in opposition to said protruding section toward a bottom edge of said medium; and wherein when the edge of said medium in the predetermined direction is on said protruding section, said ink is ejected from one of said two groups of nozzles that are not in opposition to said protruding section toward the top edge of said medium, and said ink is ejected from the one of said two groups of nozzles that are not in opposition to said protruding section toward the bottom edge of said medium.

3. A printing method according to claim 2 wherein when the number of nozzles for ejecting said ink is N, a spacing of dots formed on the medium is D, and a nozzle pitch is k×D, N and k are coprime, and a carry amount of said medium is N×D.

4. A printing method according to claim 1 wherein when the edge of said medium in the predetermined direction is on said protruding section, ink is ejected toward said medium from both of said two groups of nozzles that are not in opposition to said protruding section and that sandwich the nozzles that are in opposition to said protruding section.

5. A printing method according to claim 4 wherein when the number of nozzles for ejecting said ink is N, a spacing of dots formed on the medium is D, and a nozzle pitch is k×D, N/2 and k are coprime, and a carry amount of said medium is (N/2)×D.

6. A printing method according to claim 4 wherein when the edge of said medium in the predetermined direction is on said protruding section, said medium is carried in a carrying direction and a reverse direction, and ink is ejected alternately from one and the other of said two groups of nozzles that are not in opposition to said protruding section.

7. A printing method for printing a print image on a medium, comprising the following steps of:

supporting said medium with a protruding section provided in a predetermined position in a predetermined direction;

moving a plurality of nozzles whose positions are different from one another in a direction that intersects said predetermined direction, wherein said plurality of nozzles comprises nozzles that are in opposition to said protruding section and nozzles that are not in opposition to said protruding section while they are moved in said predetermined direction; and printing the print image on said medium by ejecting ink from the plurality of moving nozzles toward said medium supported by said protruding section, wherein when an edge of said medium in said predetermined direction is on said protruding section, said ink is not ejected from the nozzles that are in opposition to said protruding section and said ink is ejected from the nozzles that are not in opposition to said protruding section toward the edge of said medium in said predetermined direction, wherein a length of said medium in said predetermined direction is detected by detecting the edge of said medium in said predetermined direction;

whether or not the edge of said medium in said predetermined direction is on said protruding section is determined in accordance with the length of said medium in said predetermined direction;

ink that does not land on said medium is absorbed by an absorbing material;

when the edge of said medium in the predetermined direction is not on said protruding section, said ink is ejected from the nozzles that are in opposition to said protruding section and the nozzles that are not in opposition to said protruding section toward the edge of said medium in said predetermined direction;

when the edge of said medium in said predetermined direction is not on said protruding section and when a distance in said predetermined direction between a region to which said ink is ejected and said protruding section that is not supporting said medium is shorter than a predetermined distance, said ink is not ejected from the nozzles that are in opposition to said protruding section and said ink is ejected from the nozzles that are not in opposition to said protruding section toward the edge of said medium in said predetermined direction;

the nozzles that are in opposition to said protruding section are sandwiched between two groups of nozzles that are not in opposition to said protruding section;

when the edge of said medium in the predetermined direction is not on said protruding section, said ink is ejected from one of said two groups of nozzles that are not in opposition to said protruding section toward a top edge of said medium, and said ink is ejected from the other of said two groups of nozzles that are not in opposition to said protruding section toward a bottom edge of said medium; and when the edge of said medium in the predetermined direction is on said protruding section, said ink is ejected from one of said two groups of nozzles that are not in opposition to said protruding section toward the top edge of said medium, and said ink is ejected from the one of said two groups of nozzles that are not in opposition to said protruding section toward the bottom edge of said medium; and when the number of nozzles for ejecting said ink is N, a spacing of dots formed on the medium is D, and a nozzle pitch is k×D, then N and k are coprime, and a carry amount of said medium is N×D.

* * * * *